US005436124A

United States Patent [19]

Jain et al.

[11] Patent Number: 5,436,124

[45] Date of Patent: Jul. 25, 1995

[54] PHOTOGRAPHIC ELEMENTS CONTAINING PARTICULAR COLOR COUPLERS IN COMBINATION WITH POLYMERIC STABILIZERS

[75] Inventors: Rakesh Jain, Penfield; Thomas H. Jozefiak, Rochester, both of N.Y.; Hugh M. Williamson, London, England

[73] Assignee: Eastman Kodak Company, Rochester, N.Y.

[21] Appl. No.: 42,369

[22] Filed: Apr. 2, 1993

[51] Int. Cl.[6] ..... G03C 7/396

[52] U.S. Cl. ..... 430/551; 430/543; 430/546; 430/558

[58] Field of Search ..... 430/543, 558, 551, 546, 430/627

[56] References Cited

U.S. PATENT DOCUMENTS

| | | | |
|---|---|---|---|
| 3,597,215 | 8/1971 | Abel | 430/627 |
| 3,619,195 | 11/1971 | Van Campen | 96/100 |
| 3,764,327 | 10/1973 | Nogae et al. | 430/627 |
| 4,120,725 | 10/1978 | Nakazyo et al. | 430/627 |
| 4,214,047 | 7/1980 | Chen | 430/536 |
| 4,404,273 | 9/1983 | Forte et al. | 430/377 |
| 4,661,437 | 4/1987 | Tschopp | 430/390 |
| 4,857,449 | 8/1989 | Ogawa et al. | 430/546 |
| 4,871,652 | 10/1989 | Normandin | 430/387 |
| 4,906,559 | 3/1990 | Nishijima et al. | 430/551 |
| 4,914,005 | 4/1990 | Lau et al. | 430/552 |
| 4,916,050 | 4/1990 | Nishijima et al. | 430/546 |
| 4,946,770 | 8/1990 | Takahashi et al. | 430/552 |
| 5,001,045 | 3/1991 | Furutachi et al. | 430/545 |
| 5,019,490 | 5/1991 | Kobayashi et al. | 430/503 |
| 5,047,314 | 9/1991 | Sakai et al. | 430/505 |
| 5,047,315 | 9/1991 | Morigaki et al. | 430/544 |
| 5,071,738 | 12/1991 | Mizukura et al. | 430/546 |
| 5,077,188 | 12/1991 | Tanji et al. | 430/546 |
| 5,100,771 | 3/1992 | Mihayashi et al. | 430/546 |
| 5,120,637 | 6/1992 | Furusawa et al. | 430/546 |
| 5,162,196 | 11/1992 | Sato et al. | 430/558 |
| 5,206,129 | 4/1993 | Sato et al. | 430/558 |

FOREIGN PATENT DOCUMENTS

| | | | |
|---|---|---|---|
| 276319 | 8/1988 | European Pat. Off. . | |
| 324476 | 7/1989 | European Pat. Off. . | |
| 332165 | 9/1989 | European Pat. Off. . | |
| 0431374A1 | 6/1992 | European Pat. Off. . | |
| 1032260 | 2/1989 | Japan | 430/543 |
| 190348 | 7/1992 | Japan . | |
| 2072365 | 3/1981 | United Kingdom . | |
| 92/09010 | 5/1992 | WIPO . | |
| 92/14189 | 8/1992 | WIPO . | |
| 93001523 | 1/1993 | WIPO | 430/543 |

OTHER PUBLICATIONS

"Preparation and Reactions of 1,2-dicyano-1,2-disulfonylethylenes" by E. L. Martin, Journal of the American Chemical Society, Aug. 20, 1963 at p. 2449.

*Primary Examiner*—Lee C. Wright

*Attorney, Agent, or Firm*—Gordon M. Stewart

[57] ABSTRACT

A photographic element comprising a support, at least one photosensitive silver halide layer and associated therewith a color coupler and a stabilizer therefor which stabilizer is an acrylate or acrylamide homopolymer or copolymer of low water solubility, the color coupler being of the general formula (1) or (2):

(1)

(2)

wherein A and B represent the same or different electron-withdrawing group,

X is H or a group which splits off on coupling with oxidised color developer,

R is an alkyl, cycloalkyl, aryl or heterocyclic which may be substituted, $-COR^1$, $-CSR^1$, $SOR^1$, $SO_2R^1$, $-NHCOR^1$, $-CONHR^1$, $-COOR^1$, $-COSR^1$, $-NHSO_2R^1$ wherein $R^1$ is an alkyl, cycloalkyl, or aryl group any of which are optionally substituted, and wherein two or more of A, B, R, and X optionally form part of a ring, Link is a linking group and n is 0, 1 or 2.

14 Claims, 1 Drawing Sheet

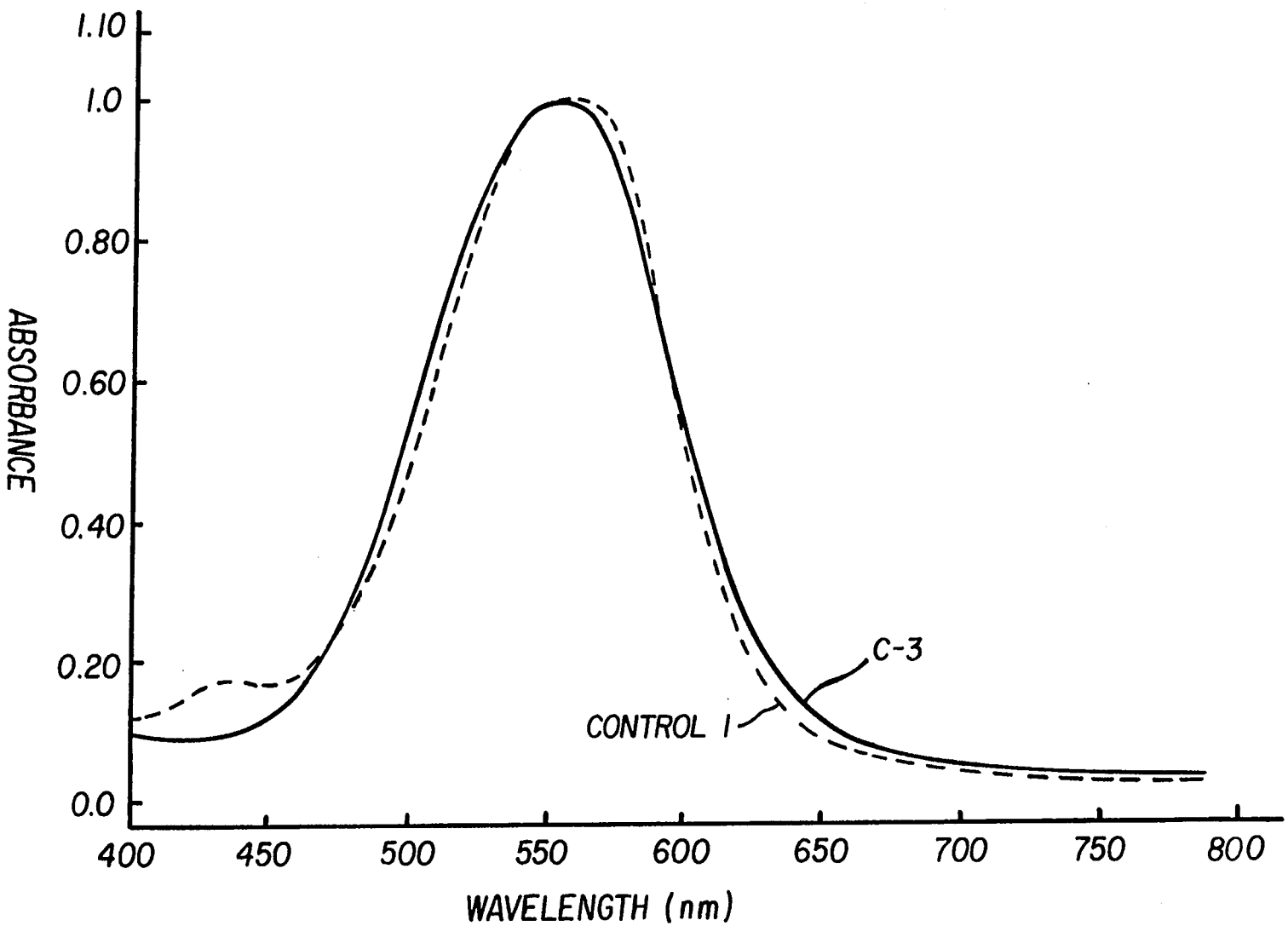
1.10
1.0
0.80
0.60
0.40
0.20
0.0
ABSORBANCE
400
450
500
550
600
650
700
750
800
WAVELENGTH (nm)
C-3
CONTROL 1

PHOTOGRAPHIC ELEMENTS CONTAINING PARTICULAR COLOR COUPLERS IN COMBINATION WITH POLYMERIC STABILIZERS

FIELD OF THE INVENTION

This invention relates to photographic elements containing both a particular class of color couplers and stabilizers that are particularly effective with the foregoing class.

BACKGROUND OF THE INVENTION

Color photographic elements typically contain several records each with silver halide sensitized to a different region of the visible light spectrum. Generally, one record is sensitized to red light, another green light and another, blue light. Each of the foregoing records also contains a color coupler which reacts with oxidized developer during processing of the element, to produce a dye in a pattern corresponding to the image to which the element was exposed. In a typical element the red, green and blue sensitive records respectively contain a cyan dye forming coupler, a magenta dye forming coupler and a yellow dye forming coupler.

As to the colour couplers, these are known to belong to a number of classes, for example magenta dye-forming couplers can be pyrazolones, pyrazolotriazoles and pyrazolobenzimidazoles while yellow dye-forming couplers can be acetanilides. European Patent Specification 0 431 374 A describes $\beta,\gamma$-unsaturated nitriles as cyan colour couplers of the general formula:

$R_2$—V=C ($R_1$)—CH(W)—CN wherein W is hydrogen or an atom or group capable of being released when the compound is subjected to a coupling reaction with oxidised product of an aromatic primary amine derivative and is attached to a carbon atom having an $sp^3$ electronic configuration, $R_1$ is a substituent, V is nitrogen or —C($R_3$)=, if V represents nitrogen, $R_2$ represents a substituent, if V represents —C($R_3$)=, $R_2$ and $R_3$ each represent a substituent, provided that at least one of $R_2$ and $R_3$ represent an electron attractive substituent, and provided that if $R_2$ or $R_3$ represents an aliphatic group or an aromatic group, the other does not represent an acyl group, and $R_1$ and $R_2$ may bond together to form a ring.

The couplers of the above general formula are said to have less subsidiary absorption in the blue region of the spectrum. In support of this contention one drawing (FIG. 1) and a table of data are provided wherein the dye formed from Coupler 53 is compared to that from Comparative Compound (1)—a phenolic coupler.

The color couplers used in the photographic elements of the present invention, as described below, are distinct from those of European Specification 0 431 374A because, inter alia, the coupling position is a carbon atom having an $sp^2$ electronic configuration and the compounds are $\alpha,\beta$-unsaturated. No examples of them appear in EP 0 431 374A, nor is any method of making them disclosed.

"Preparation and Reactions of 1,2-dicyano-1,2-disulfonylethylenes" by E. L. Martin, Journal of the American Chemical Society, Aug. 20, 1963 at page 2449, describes compounds of the formula:

RNH—C(CN)=C(CN)—$SO_2$R.

The method of preparation means that only compounds having the —$SO_2$R can be prepared. In addition there is no disclosure of ballasted compounds.

It has previously been found that known magenta couplers may have a tendency to yellow in unexposed areas of the photographic element, following processing. This problem is frequently referred to as fresh $D_{min}$ yellowing. This results in an undesirable yellowing which is particularly evident in the white, unexposed areas of color papers incorporating such couplers. Previously, it has been found that certain organic polymers can be incorporated into silver halide elements to reduce dye fade, fresh $D_{min}$ yellowing, or yellowing after prolonged exposure to light, heat and humidityl. Useful materials and procedures are described in U.S. Pat. No. 3,619,195, U.S. Pat. No. 4,857,449, U.S. Pat. No. 4,916,050, U.S. Pat. No. 4,946,770, U.S. Pat. No. 5,001,045, U.S. Pat. No. 5,019,490, U.S. Pat. No. 5,047,314, U.S. Pat. No. 5,047,315, U.S. Pat. No. 5,071,738, U.S. Pat. No. 5,077,188, U.S. Pat. No. 5,100,771, U.S. Pat. No. 5,120,637 and also EP 276,319, EP 332,165, EP 324,476.

It is desirable then, to provide photographic elements which incorporate a color coupler with advantageous properties, and which elements also incorporate a stabilizer which is effective at reducing fresh $D_{min}$.

SUMMARY OF THE INVENTION

The present invention provides photographic elements containing a particular class of couplers in combination with a particularly effective class of stabilizers. As to the color couplers, these are capable of forming dyes having good spectral characteristics such as maximum wavelength ($\lambda_{max}$) and half-band width, little unwanted absorption of blue light and good fastness properties. Both magenta and yellow dye formation has been observed, although the present invention is particularly directed toward magenta dye froming couplers.

According to the present invention there are provided photographic elements comprising at least one photosensitive silver halide layer and in or adjacent said silver halide layer a colour coupler of the class described below. The elements also comprise a stabilizer for the color coupler which stabilizer is an acrylate or acrylamide homopolymer or copolymer of low water solubility. By "low water solubility" means that the stabilizer will be soluble enough in the dispersion containing the color coupler, but insoluble enough in water, such that a sufficient amount of stabilizer remains in the color coupler dispersion to provide a reduction in fresh $D_{min}$.

As to the color coupler, these are of the general formulae:

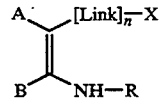

(1)

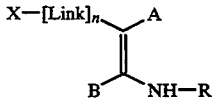

(2)

wherein A and B represent the same or different electron-withdrawing group,

X is H or a group which splits off on coupling with oxidised colour developer,

R is an alkyl, cycloalkyl, aryl or heterocyclic group any of which may be substituted, —$COR^1$, —$CSR^1$, $SOR^1$, $SO_2R^1$, —$NHCOR^1$, —$CONHR^1$, —$COOR^1$, —$COSR^1$, —$NHSO_2R^1$ wherein $R^1$ is an alkyl, cycloalkyl, or aryl group any of which are optionally substituted, and wherein two or more of A, B, R, and X optionally form part of a ring, Link is a linking group and n is 0, 1 or 2.

It is noted that formulae (1) and (2) represent geometric isomers (cis and trans versions) of the same compound.

The advantages of the present invention include the provision of couplers of good activity capable of forming dyes having good spectral characteristics such as maximum wavelength ($\lambda_{max}$) and half-band width, little unwanted absorption of blue light, good fastness properties, $\lambda_{max}$ selectable under the influence of coupler solvents, and easy bleaching giving retouchability. In addition, the presence of the stabilizer reduces fresh $D_{min}$.

EMBODIMENTS OF THE INVENTION

Particular embodiments of first, the color couplers used in the photographic elements of the present invention, and then the stabilizers, will now be described. Further details of embodiments of the elements are then provided.

First, with regard to the color couplers used in the elements of the present invention, in one embodiment A and B of the above formulae (1) and (2) together may complete an electron-withdrawing heterocycle which may be substituted. In another embodiment R and X together complete a heterocyclic ring which is optionally substituted In one embodiment of the present invention the couplers contain a ballasting group of such size and configuration to render the coupler non-diffusible in the photographic material.

A and B may each individually represent an electron attractive group wherein the value of the Hammett substituent constant $\sigma_p$ (SIGMA$_p$ as defined by Hansch et al, J. Med. Chem.,1973, 16, 1207; and ibid. 1977, 20, 304) is 0.03 or greater, preferably 0.35 or greater and more preferably 0.5 or above.

A substituent or atom wherein the value of the $\sigma_p$ (SIGMA$_p$) is 0.03 or above includes a fluorine atom, a chlorine atom, a bromine atom, an iodine atom, a substituted alkyl group (eg. trichloromethyl, trifluormethyl, chloromethyl and perfluorobutyl), a nitrile group, an acyl group (eg. formyl, acetyl and benzoyl), a carboxyl group, a substituted or unsubstituted carbamoyl group (eg. methylcarbamoyl) an aromatic group substituted by another electron attractive group (eg pentachlorophenyl, pentafluorophenyl), a heterocyclic group (eg. 2-thienyl, 2-benzoxazolyl, 2-benzthiazolyl, 1-tetrazolyl and 1-phenyl-2-benzimidazolyl), a nitro group, an azo group (eg. phenylazo), an amino group substituted by another electron attractive group (eg. ditrifluoromethylamino), an alkoxy group substituted by another electron attractive group (eg. trifluoromethoxy), an alkylsulphonyloxy group (eg. methanesulphonyloxy), an acyloxy group (eg. acetyloxy, benzoyloxy), an arylsulphonyloxy group (eg. benzenesulphonyloxy), a phosphoryl group (eg. dimethoxyphosphoryl and diphenylphosphoryl), a thioalkyl group substituted by another electron attractive group (eg. trifluoromethyl), a sulphamoyl group, a sulphonamide group, a sulphonyl group (eg. methanesulphonyl, benzenesulphonyl), a thiocyanate group and a sulphoxide group.

Examples of electron-withdrawing groups which A and B may represent are hydrogen, halogen, —CN, —$NO_2$, —$OR^4$, —$SR^4$, —$SO_2R^1$, —$OSO_2R^1$, —$SOR^1$, —$NHCOR^1$, —$CONHR^1$, —$OCONHR^1$, —NH—CO—$OR^1$, —$SO_2NH$—$R^1$, —$NHSO_2R^1$, —NH—$SO_2NHR^1$, —NHNH—$SO_2$—$R^1$, —COOH, —$COOR^1$, —O—$COR^1$, —$COR^1$, —$CSR^1$, —$CONHNHR^1$, —$CF_3$, —$NH_2$, —$NHR^1$, —$NHR^1R^{1'}$, silyloxy, aryl, aralkyl, alkyl, cycloalkyl, ureido, imido, or a heterocycle, wherein $R^1$ is as defined above, $R^{1'}$ has the same definition as $R^1$ and may be the same or different to $R^1$, and $R^4$ is an alkyl, cycloalkyl, aryl or heterocyclic group any of which are optionally substituted, and wherein the nature of the groups $R^1$, $R^{1'}$ and $R^4$ and the substituents thereon are such that the group is electron-withdrawing.

The groups A and B may be also be any of the above groups joined by way of a group that will extend the conjugated path from A or B to the —NH—R group while leaving the whole group electron-withdrawing. Such a group may have the formula:

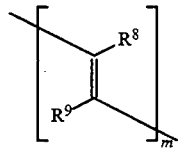

wherein $R^8$ and $R^9$ are each hydrogen, halogen, or an alkyl or aryl group that may be substituted, or $R^8$ and $R^9$ may complete a carbocyclic or heterocyclic ring, and m is 1 or 2.

The ballast group may be located as part of A, B, X or R. Preferably the ballast group is part of R.

A preferred class of groups R have the general formula:

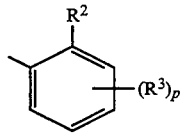

wherein p is 0, 1, 2, 3 or 4 and each $R^3$ is preferably in a meta or para position with respect to $R^2$ (if vacant);

each $R^3$ is individually a halogen atom or an alkyl, alkoxy, aryloxy, carbonamido, carbamoyl, sulphonamido, sulfamoyl, alkylsulphoxyl, arylsulphoxyl, alkylsulphonyl, arylsulphonyl, alkoxycarbonyl, aryloxycarbonyl, acyloxy, ureido, imido, carbamate, cyano, nitro, acyl, trifluoromethyl, alkylthio, carboxyl or heterocylic group; and $R^2$ is a hydrogen or halogen atom or an alkyl, alkoxy, aryloxy, alkylthio, arylthio, carbonamido, carbamoyl, sulphonamido, sulphamoyl, alkylsulphonyl, arylsulphonyl, alkoxycarbonyl, acyloxy, acyl, cyano, nitro, or trifluoromethyl group.

Specific groups which R may represent are listed in the following table (Table 1).
TABLE 1
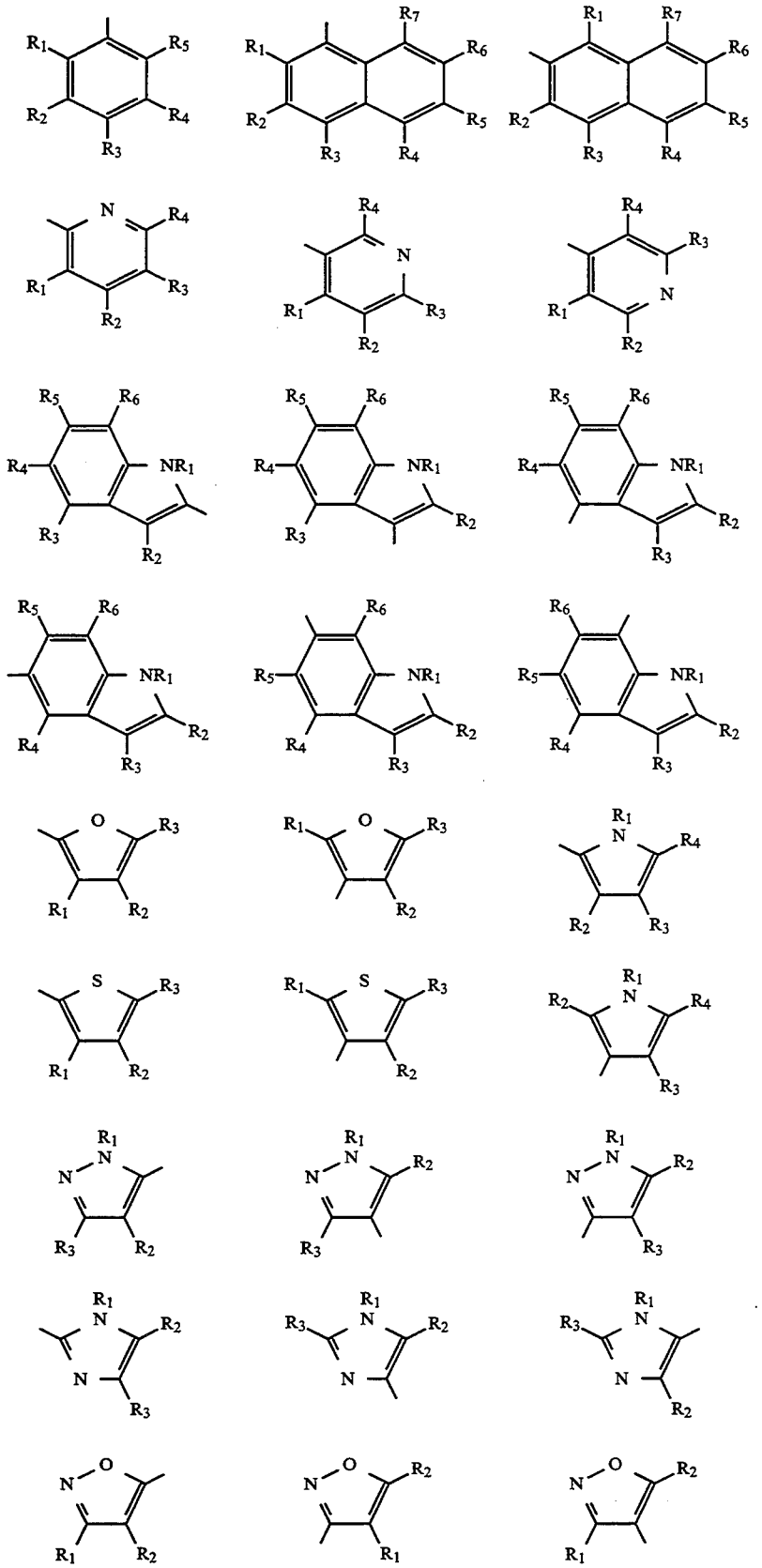

TABLE 1-continued
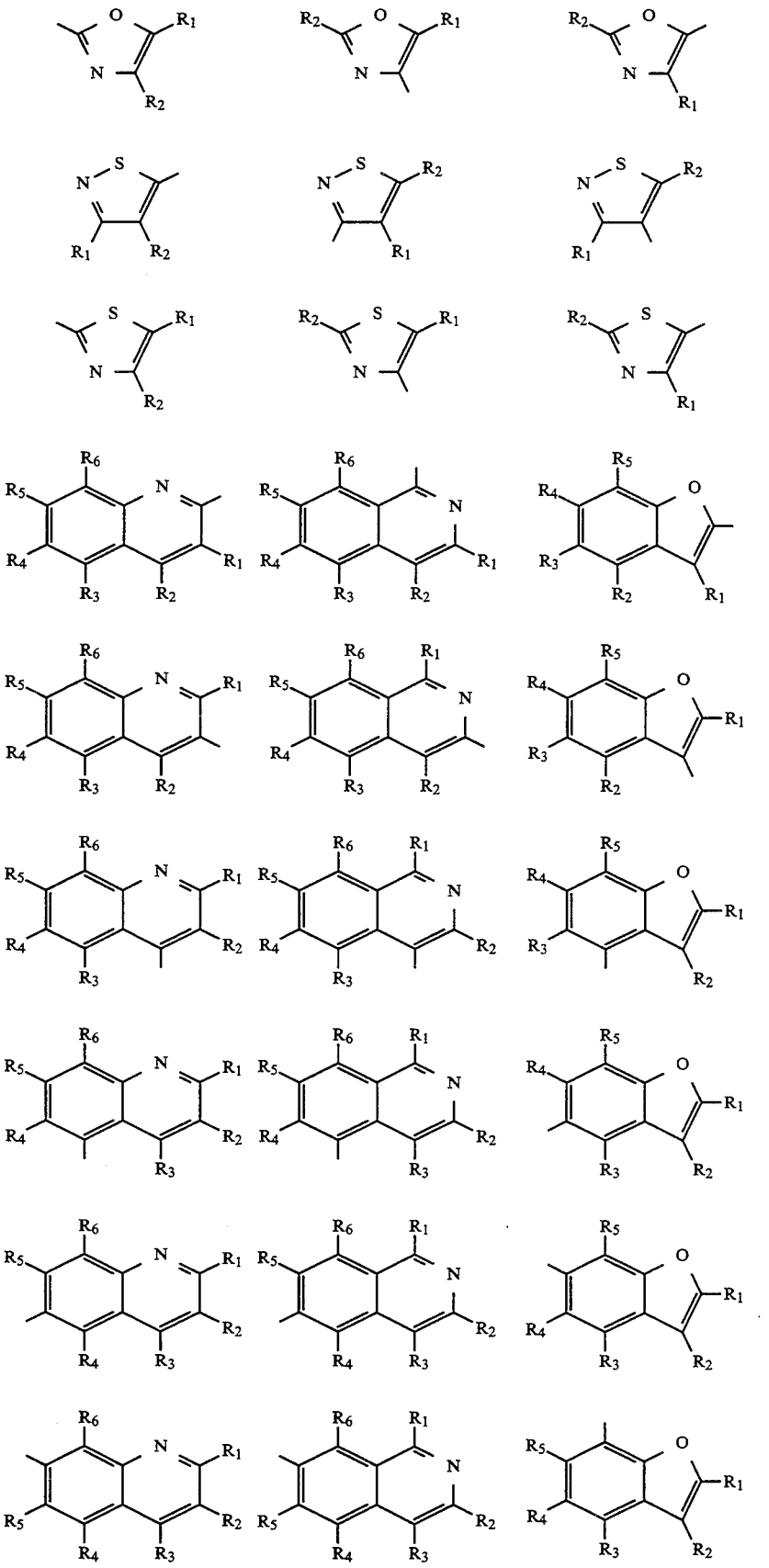

TABLE 1-continued

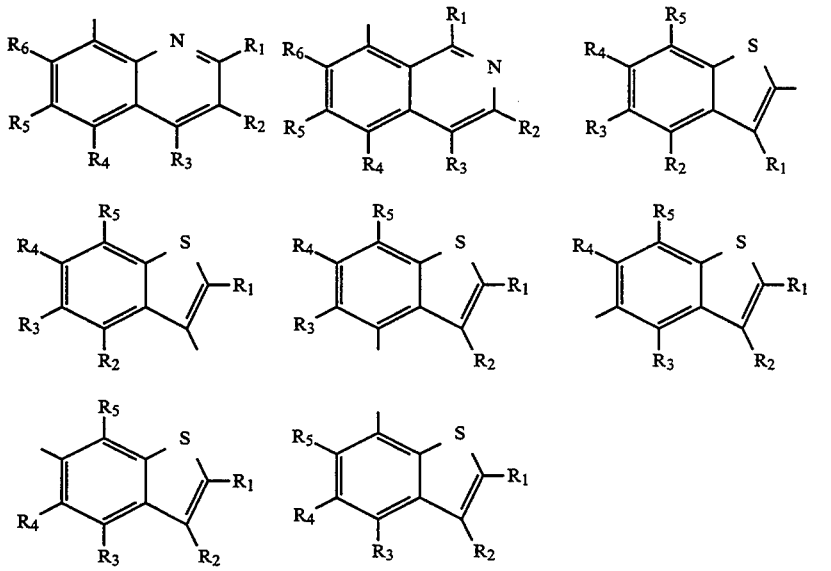

In the above groups the groups $R_1$ to $R_5$ are substituents not incompatible with the function of the compound. Examples of such substituents are those listed above for $R^2$ and $R^3$.

The ballast group or X may have water-solubilising substituents thereon and, in particular, those groups which will increase the activity of the coupler.

Examples of coupling-off groups which X may represent are shown in Table 3 below (a listing of compounds useful in the present invention).

The coupling-off group X may comprises the radical of a photographically useful group, for example a developer inhibitor or accelerator, a bleach accelerator, etc. Such groups are referred to in the Research Disclosure article referred to below.

Link may be a timing group which can be used to speed or slow release of a photographically useful group. Two timing groups may be used in circumstances where staged release is required.

The timing groups may have one of the following formulae shown in Table 2 in which they are shown attached to a photographically useful group (PUG):

TABLE 2

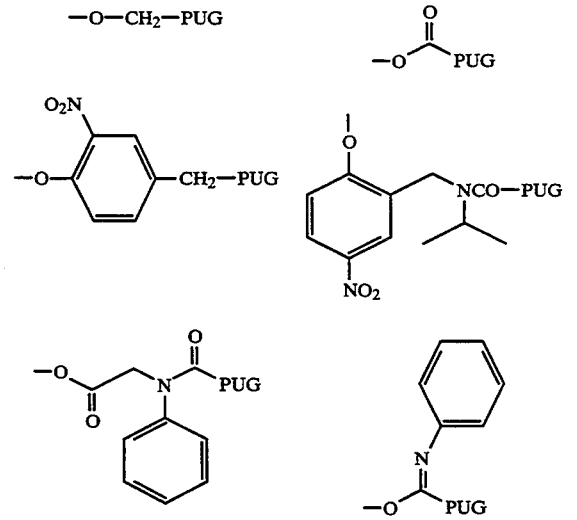

TABLE 2-continued

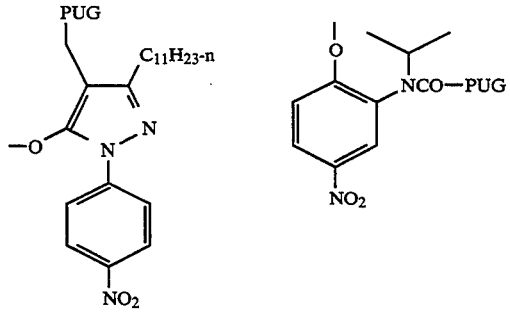

Specific examples of groups which $R^3$ may represent are given in the list of compounds useful in the present invention listed in Table 3 below.

Examples of groups which split off on coupling include halogen, carboxy, heterocyclyl joined via a ring carbon or hetero atom in the heterocyclic nucleus, $—OR^4$, $—SR^4$, arylazo or heterocyclylazo. Chloro is a particularly preferred coupling-off group as it gives the coupler superior activity. The group which splits off may provide a photographically useful compound. Many such groups are often known as photographically useful groups and they provide developer inhibitors, bleach accelerators, developer accelerators, antifoggants, competing couplers, etc. Many examples are listed in Research Disclosure Item 119, December 1989 published by Kenneth Mason Publications, Emsworth, Hants, United Kingdom.

The color couplers used in the elements of the present invention may further be of the general formulae:

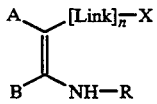

(3)

-continued

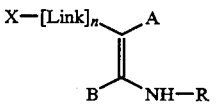

(4)

wherein A and B represent the same or different electron-withdrawing group,

X is H or a group which splits off on coupling with oxidised colour developer,

R is an alkyl, cycloalkyl, aryl or heterocyclic group any of which may be substituted, —$COR^1$, —$CSR^1$, $SOR^1$, $SO_2R^1$, —$NHCOR^1$, —$CONHR^1$, —$COOR^1$, —$COSR^1$, —$NHSO_2R^1$ wherein $R^1$ is an alkyl, cycloalkyl, or aryl group any of which are optionally substituted, and wherein two or more of A, B, R, and X optionally form part of a ring, Link is a linking group and n is 0, 1 or 2.

Examples of couplers of the foregoing type which are useful in the elements of the present invention are listed in Table 3 below.

TABLE 3

(C-1)

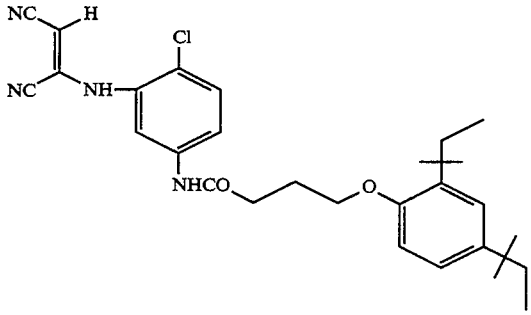

(C-2)

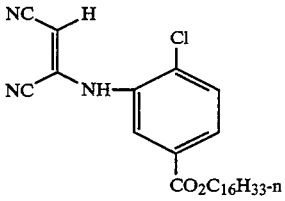

(C-3)

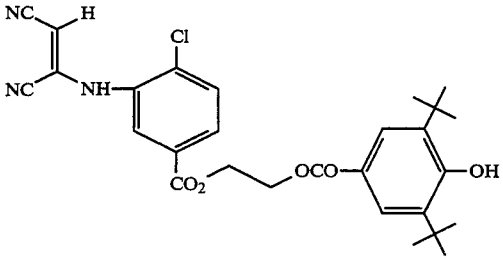

(C-4)

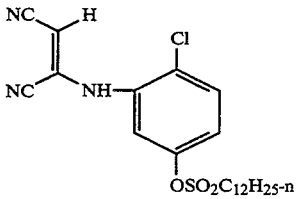

(C-5)

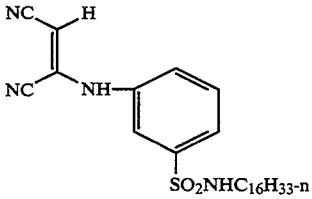

(C-6)

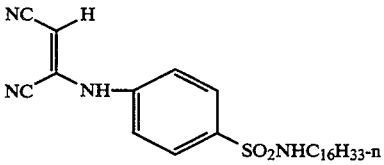

TABLE 3-continued
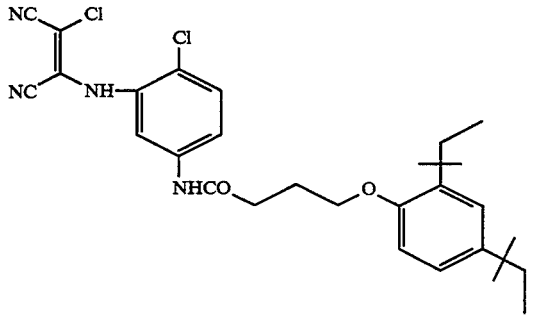
(C-7)
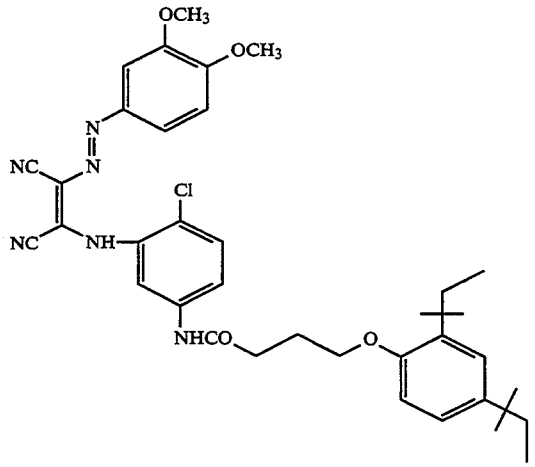
(C-8)
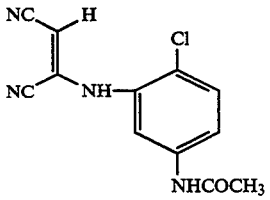
(C-9)
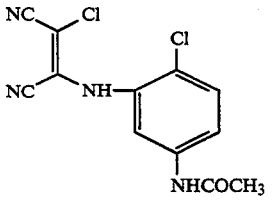
(C-10)
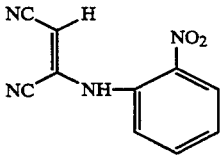
(C-11)
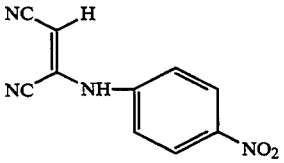
(C-12)
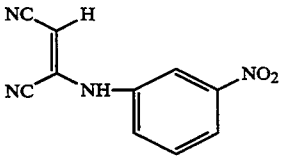
(C-13)
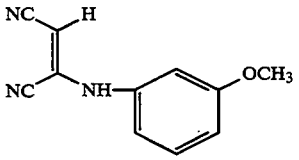
(C-14)
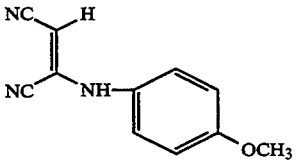
(C-15)
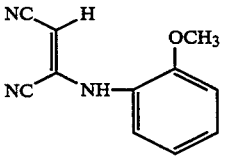
(C-16)

TABLE 3-continued
(C-17)
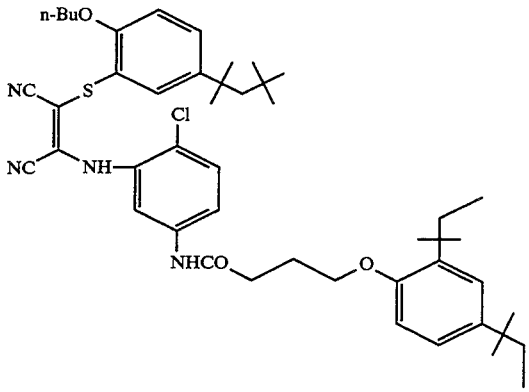
(C-18)
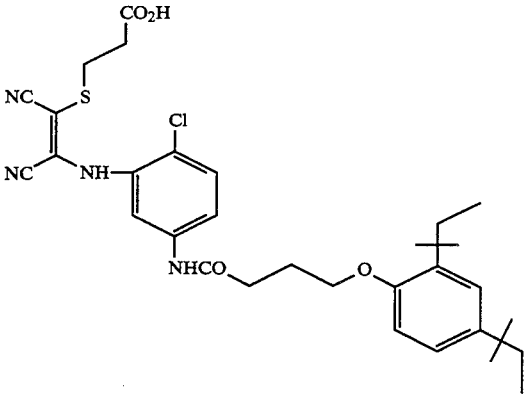
(C-19)
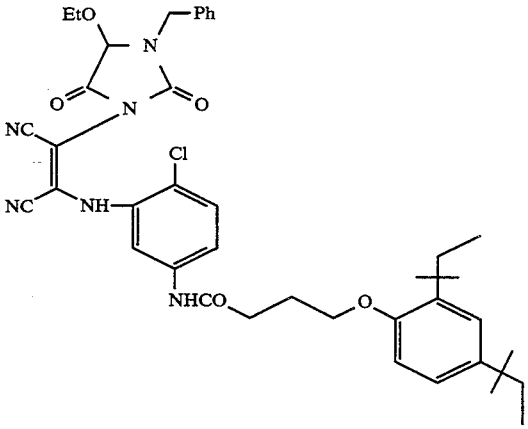
(C-20)
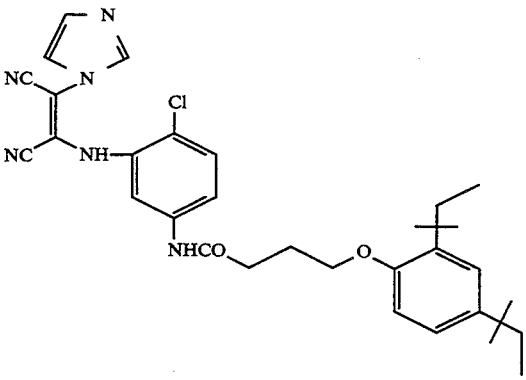

TABLE 3-continued
(C-21)
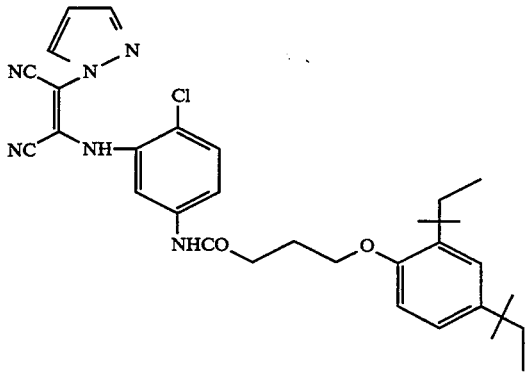
(C-22)
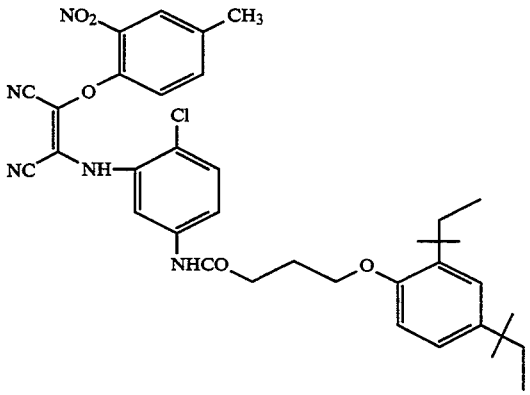
(C-23)
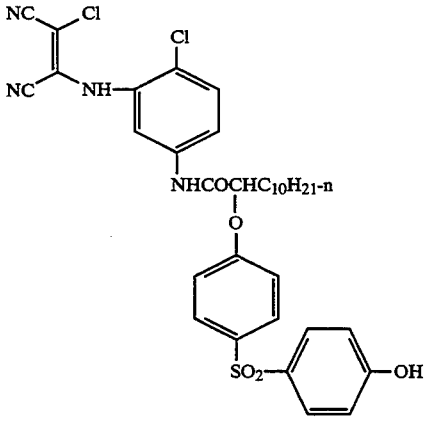

TABLE 3-continued
(C-24)
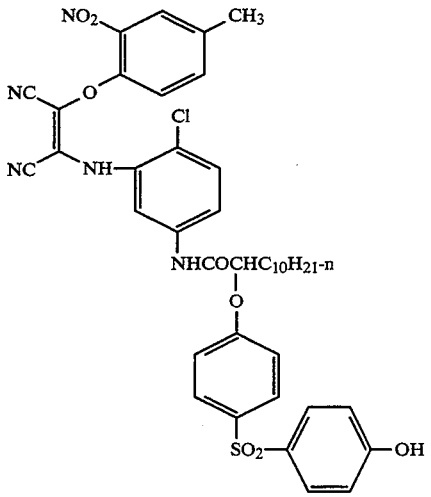
(C-25)
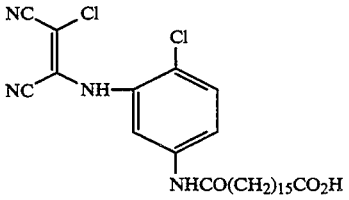
(C-26)
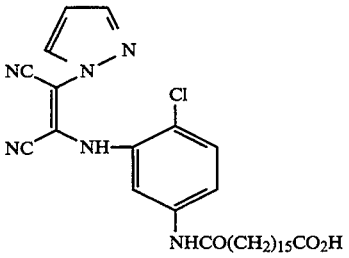
(C-27)
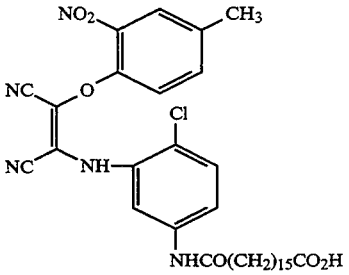
(C-28)
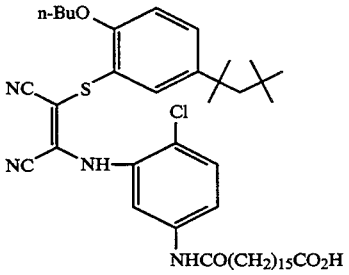

TABLE 3-continued
(C-29)
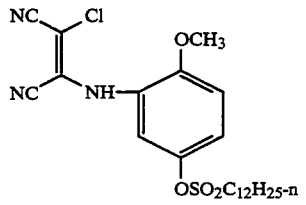
(C-30)
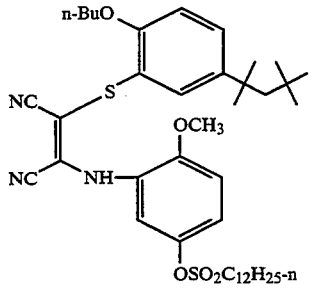
(C-31)
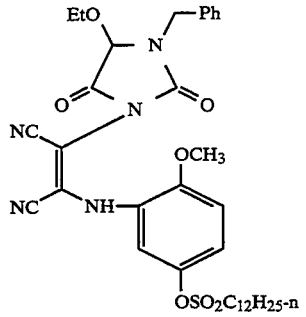
(C-32)
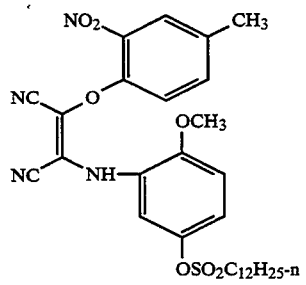
(C-33)
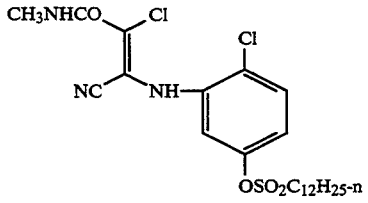
(C-34)
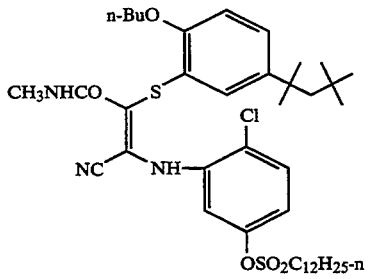

TABLE 3-continued
(C-35)
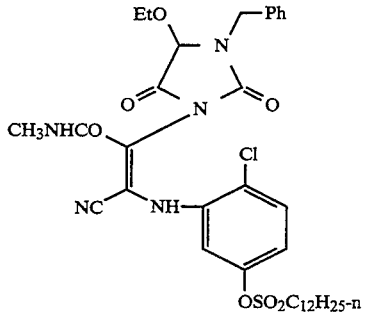
(C-36)
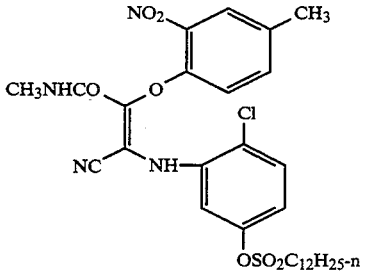
(C-37)
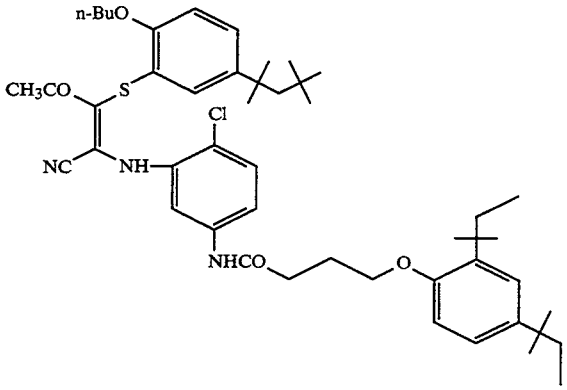
(C-38)
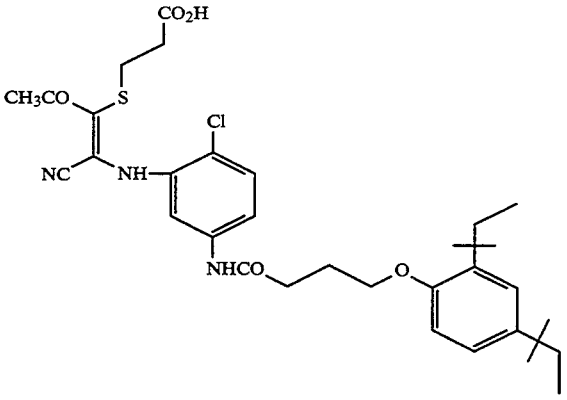

TABLE 3-continued
(C-39)
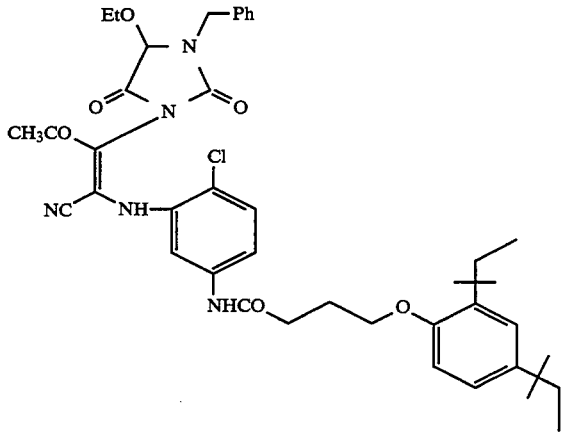
(C-40)
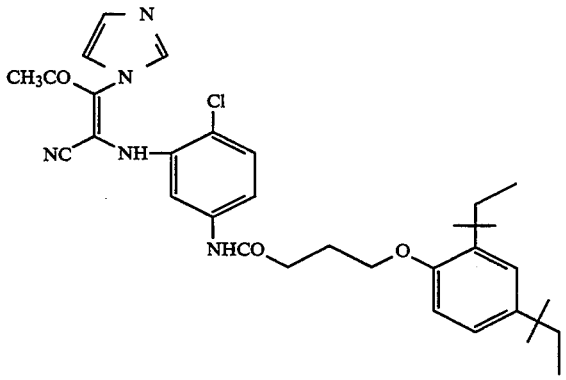
(C-41)
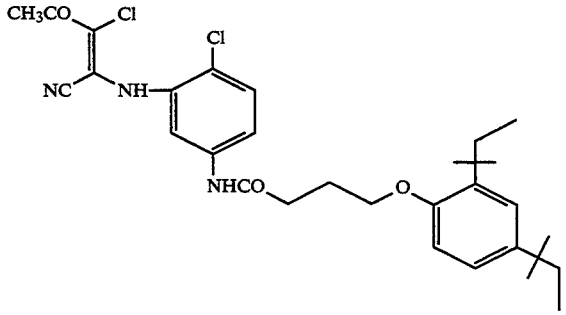
(C-42)
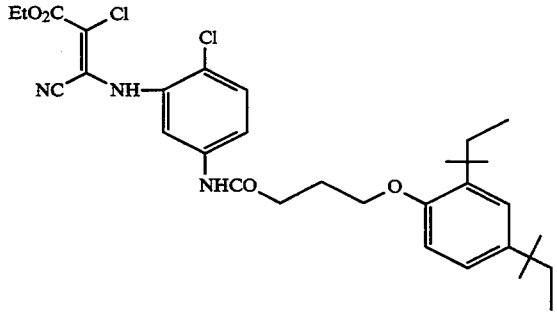

TABLE 3-continued
(C-43)
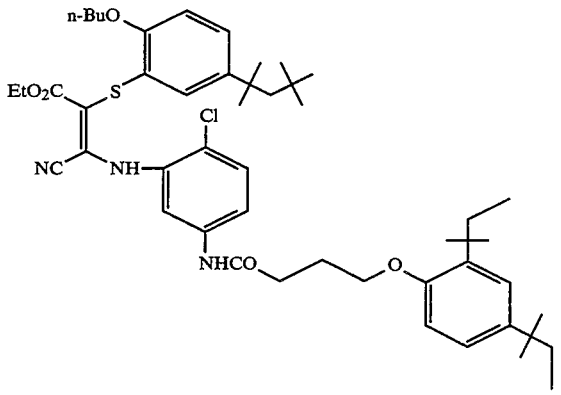
(C-44)
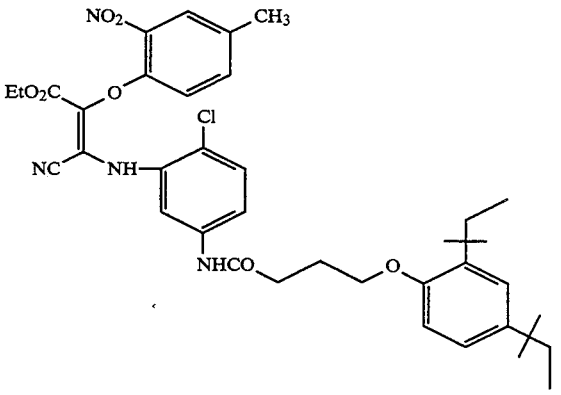
(C-45)
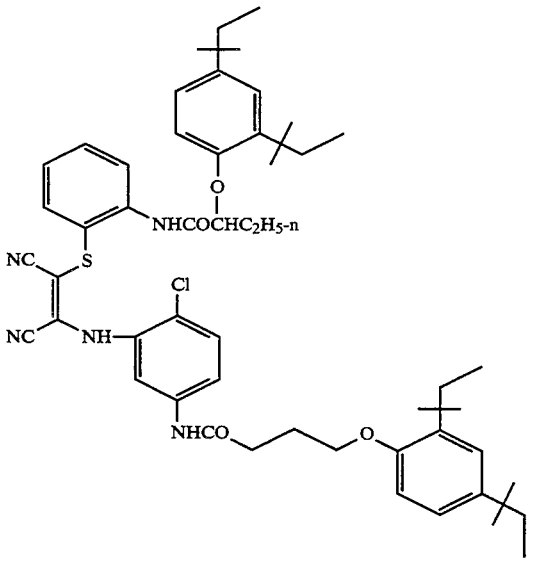

TABLE 3-continued
(C-46)
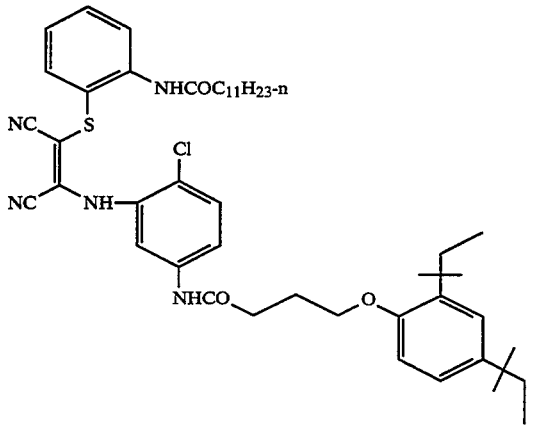
(C-47)
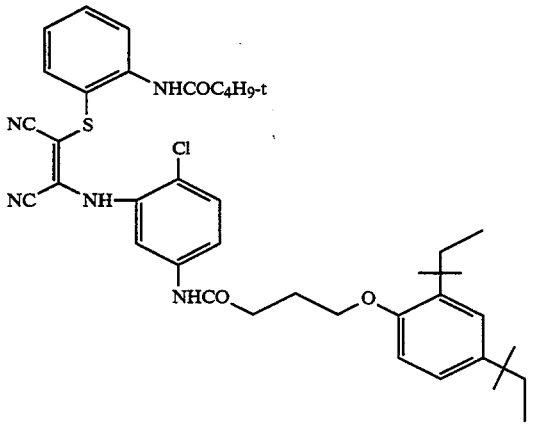
(C-48)
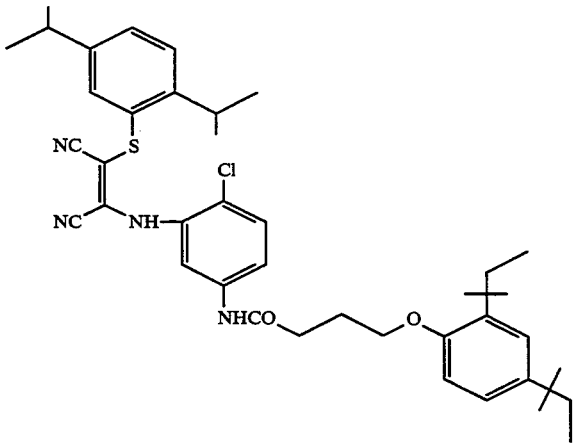

TABLE 3-continued
(C-49)
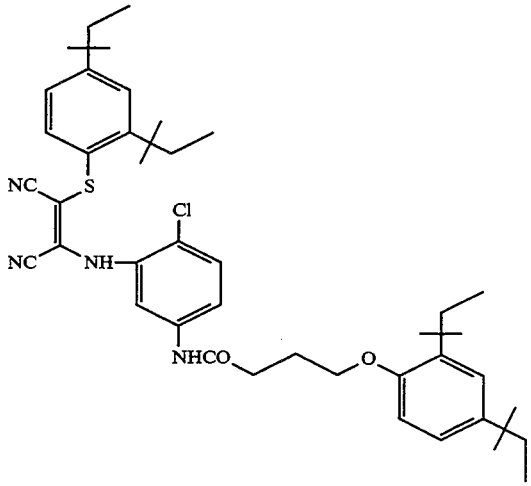
(C-50)
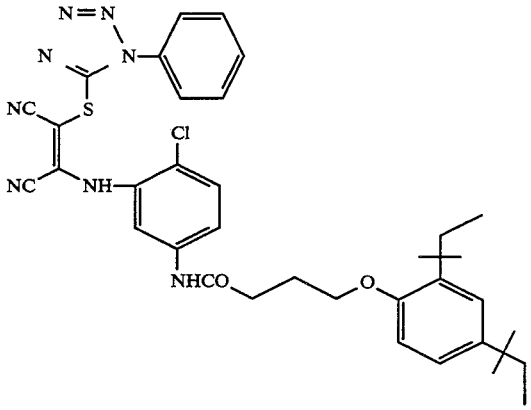
(C-51)
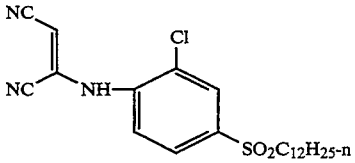
(C-52)
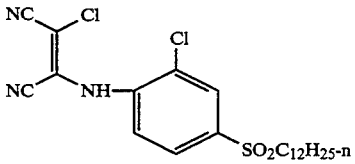
(C-53)
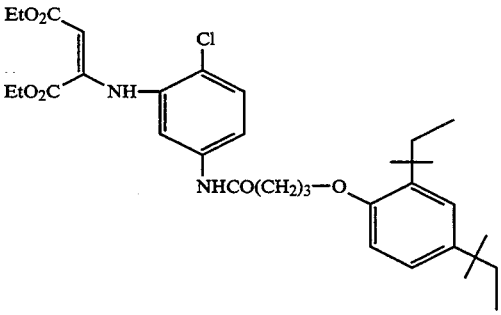

TABLE 3-continued
(C-54)
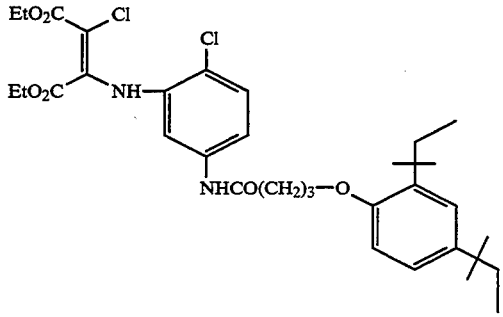
(C-55)
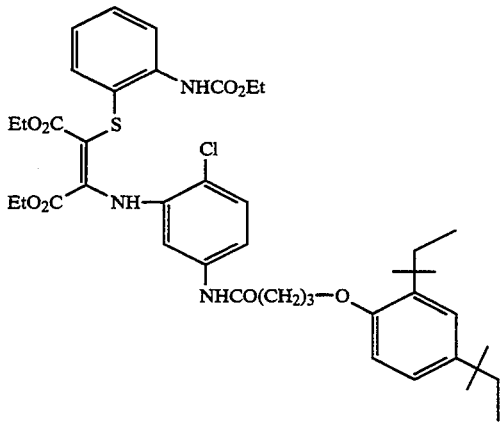
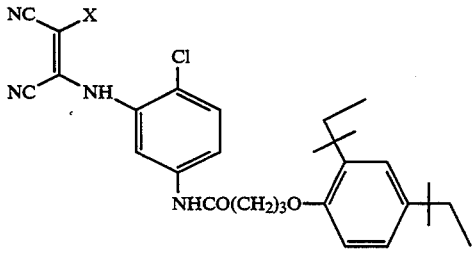
Where X is:-
C-56
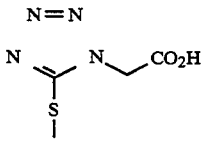
C-57
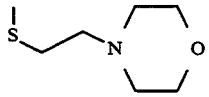
C-58
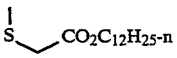
C-59
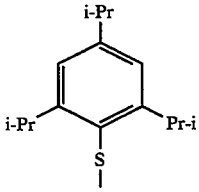
C-60
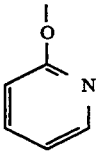
C-61
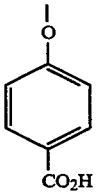
C-62
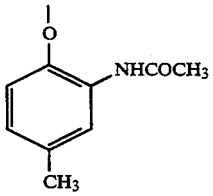
C-63
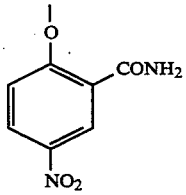
C-64
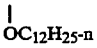
C-65
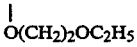
C-66
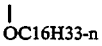
C-67
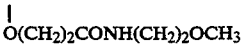
C-68 C-69 C-70 C-71

TABLE 3-continued
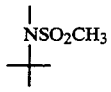
C-72
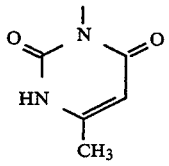
C-73
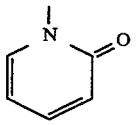
C-74
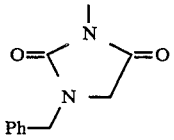
C-75
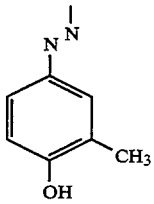
C-76
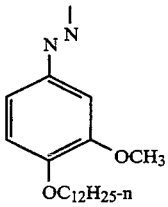
C-77
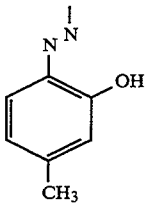
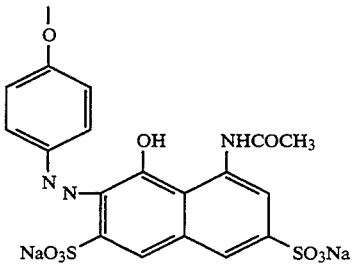
C-78
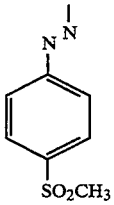
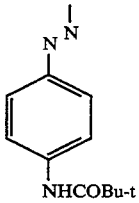
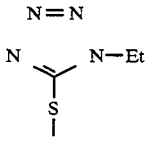
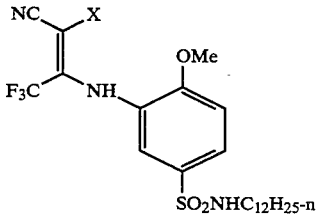
Where X is:-
C-79
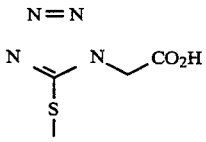
C-80
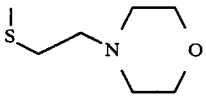
C-81
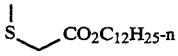
C-82
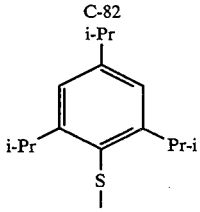
C-83
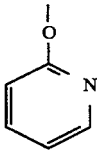
C-84
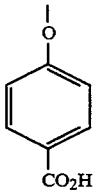
C-85
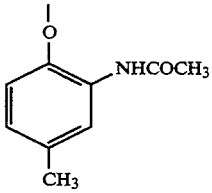
C-86
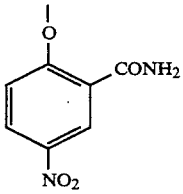
C-87
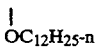
C-88
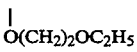
C-89
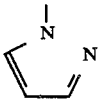
C-90
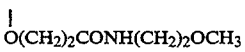
C-91 C-92 C-93 C-94

TABLE 3-continued
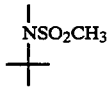
C-95
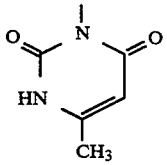
C-96
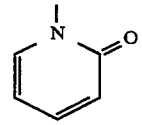
C-97
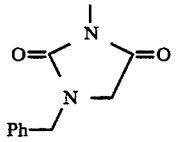
C-98
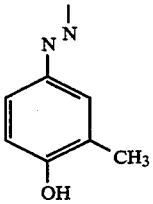
C-99
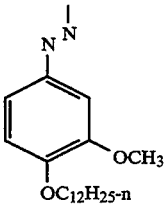
C-100
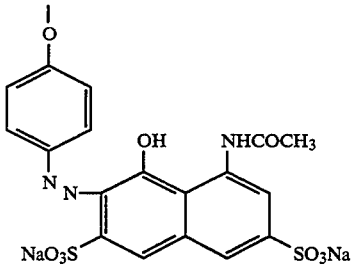
C-101
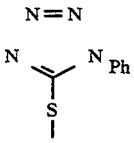
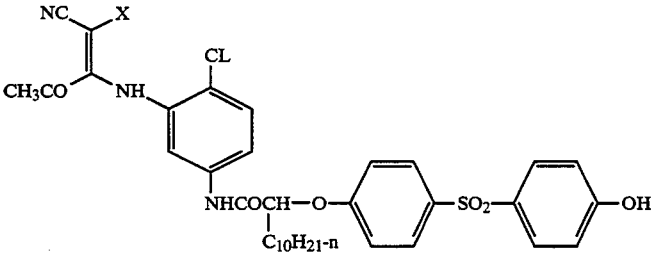
Where X is:-
C-102
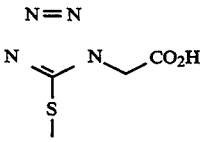
C-103
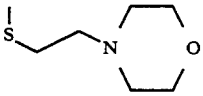
C-104
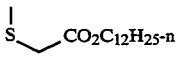
C-105
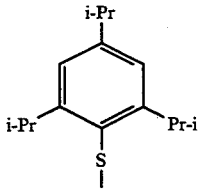
C-106
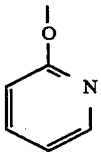
C-107
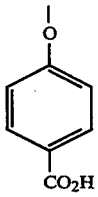
C-108
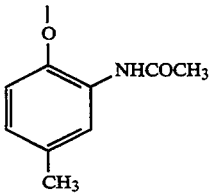
C-109
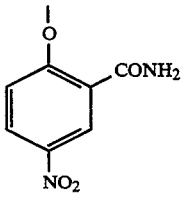
C-110
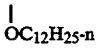
C-111
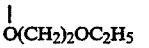
C-112
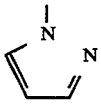
C-113
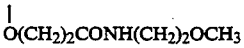

TABLE 3-continued
C-114
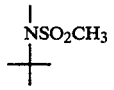
C-115
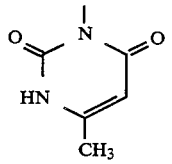
C-116
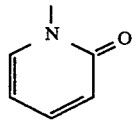
C-117
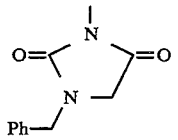
C-118
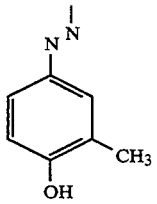
C-119
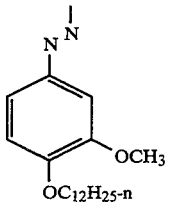
C-120
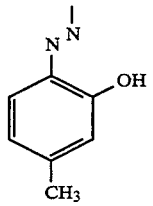
C-121
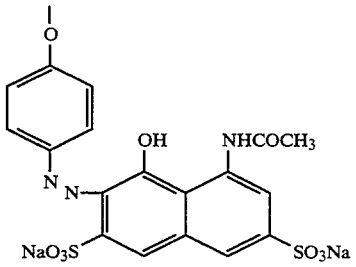
C-122
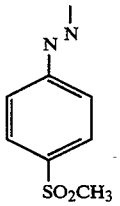
C-123
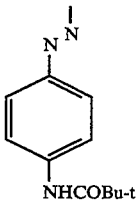
C-124
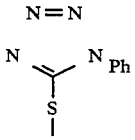
C-125
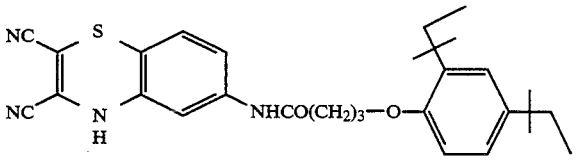
C-126
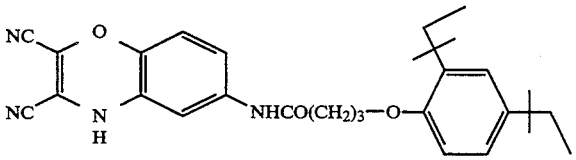
C-127
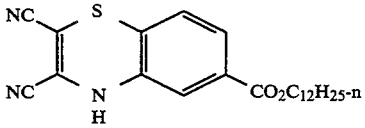
C-128
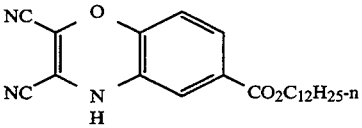
C-129
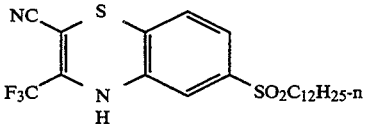
C-130
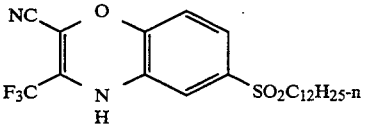
C-131
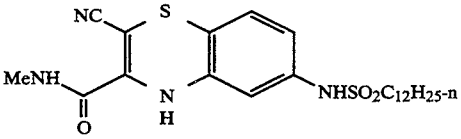
C-132
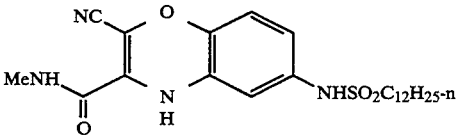

TABLE 3-continued
C-133
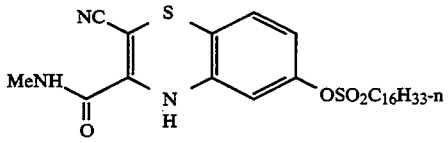
C-134
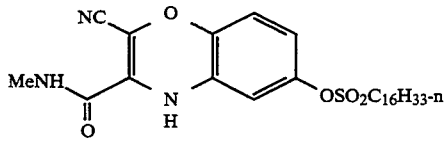
C-135
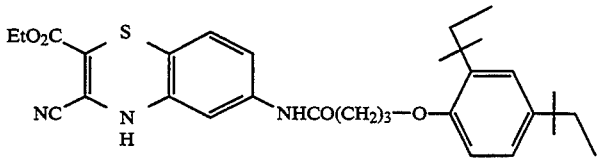
C-136
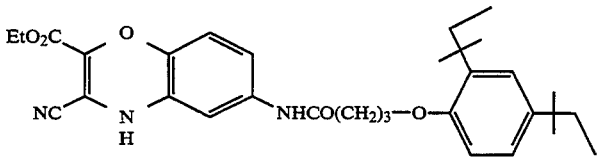
C-137
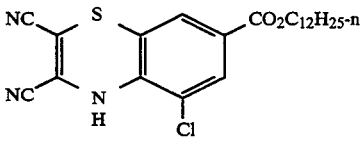
C-138
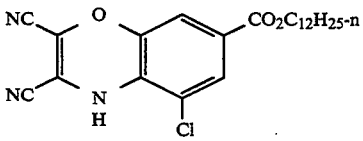
C-139
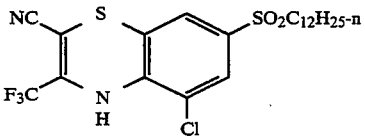
C-140
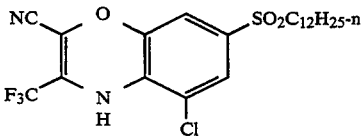
C-141
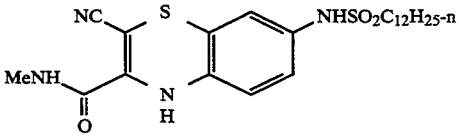
C-142
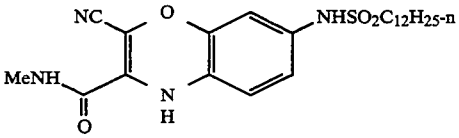
C-143
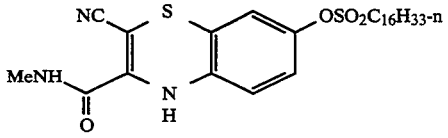
C-144
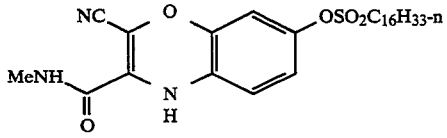
C-145
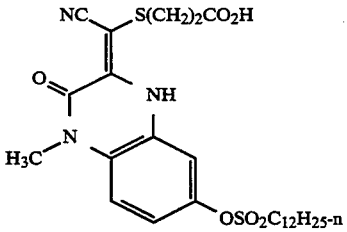
C-146
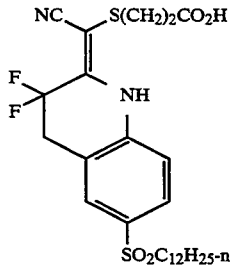
C-147
C-148

TABLE 3-continued
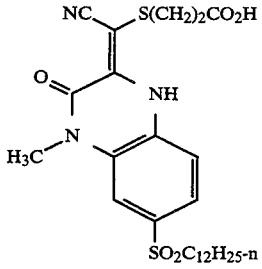
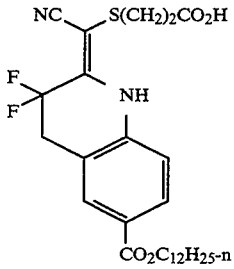
C-149
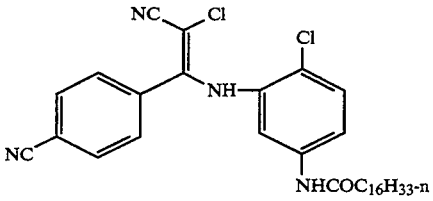
C-150
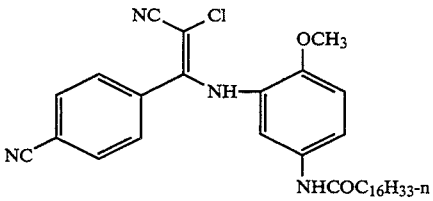
C-151
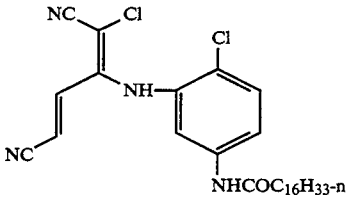
C-152
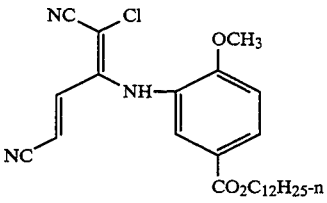
C-153
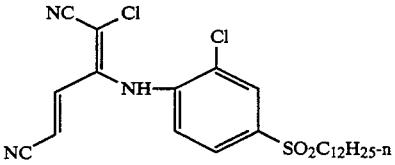
C-154
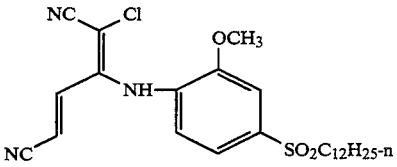
C-155
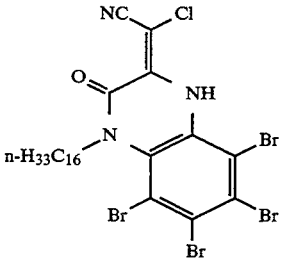
C-156
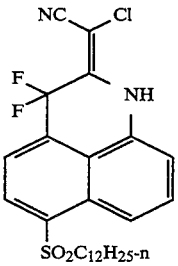
C-157
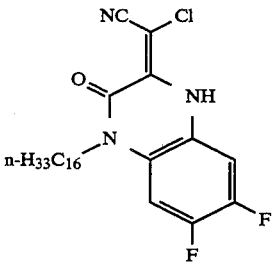
C-158
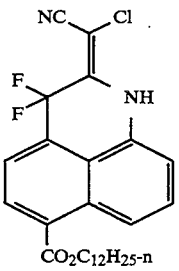
C-159
C-160

TABLE 3-continued
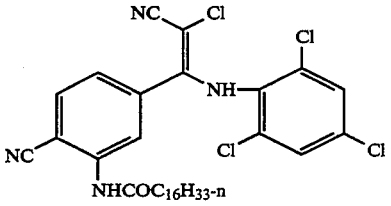
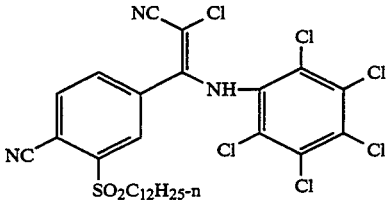
C-161
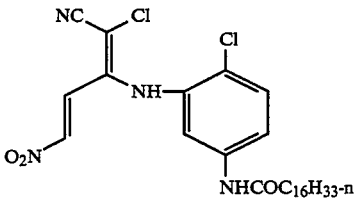
C-162
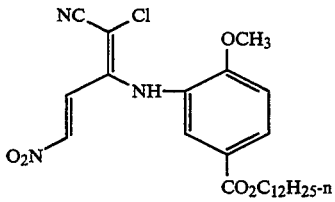
C-163
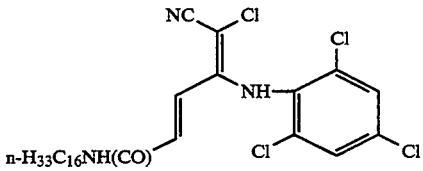
C-164
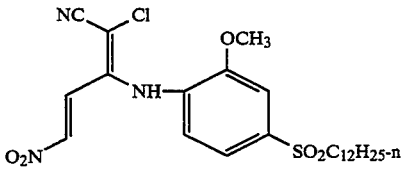
(C-165)
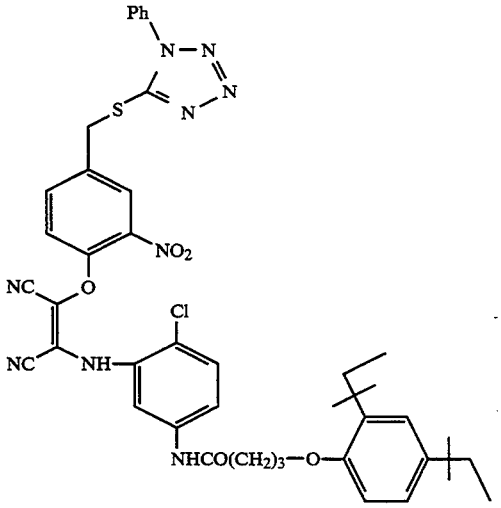
(C-166)
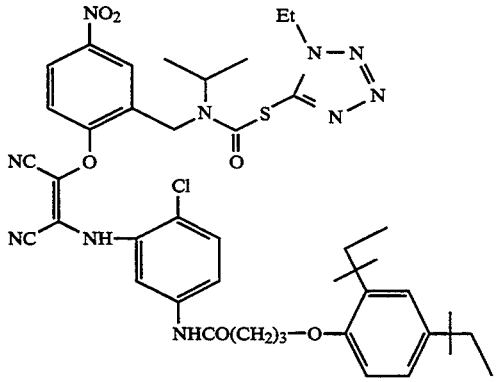

TABLE 3-continued
(C-167)
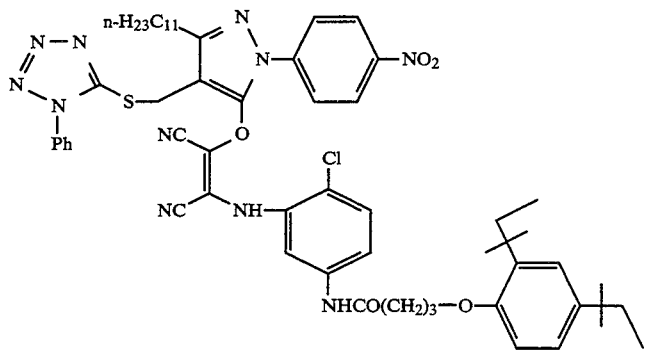
(C-168)
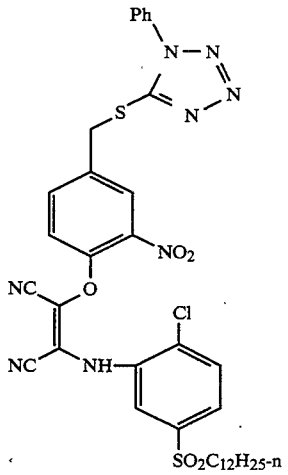
(C-169)
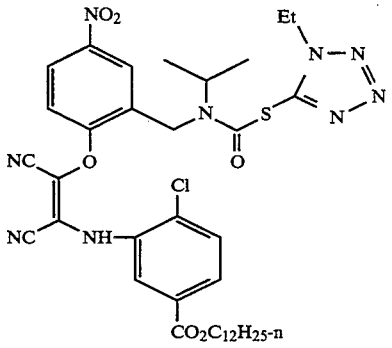
(C-170)
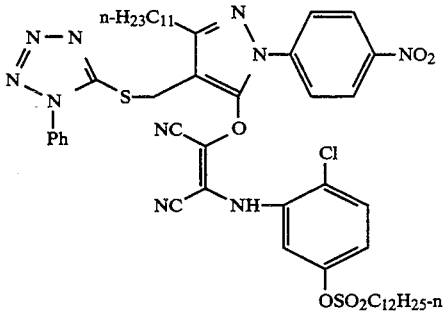

TABLE 3-continued
(C-171)
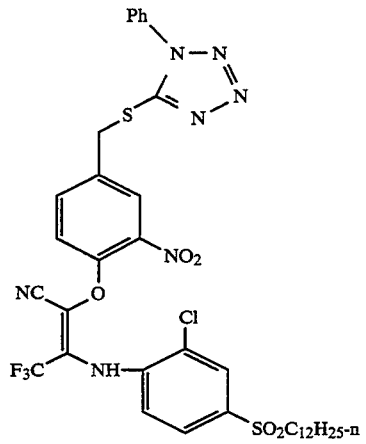
(C-172)
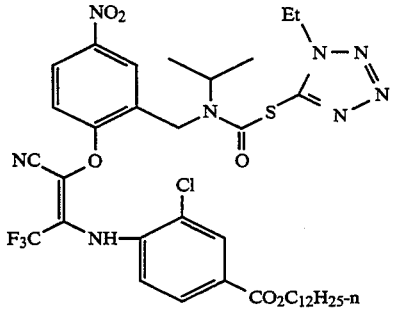
(C-173)
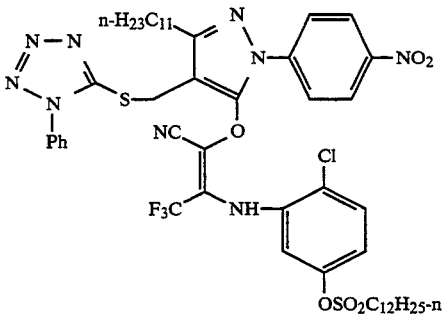
(C-174)
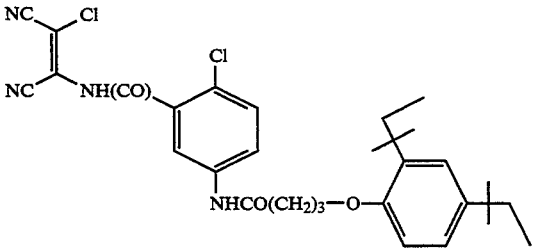
(C-175)
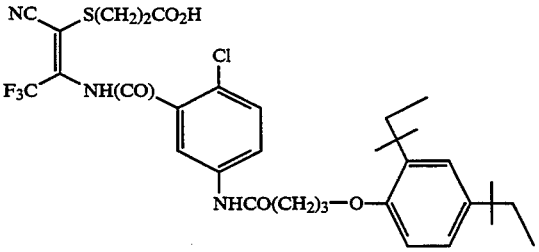

TABLE 3-continued
(C-176)
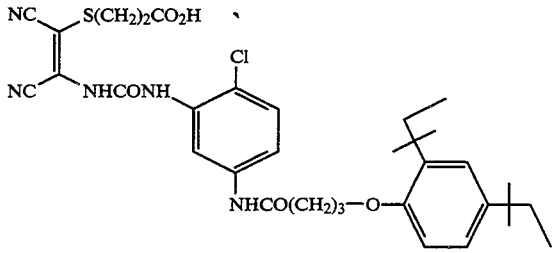
(C-177)
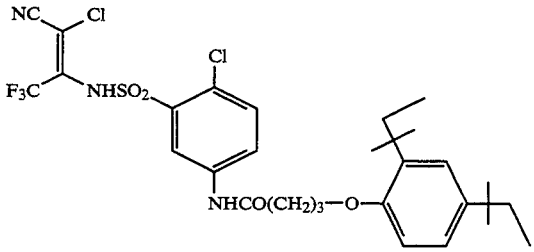
(C-178)
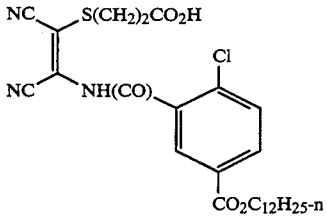
(C-179)
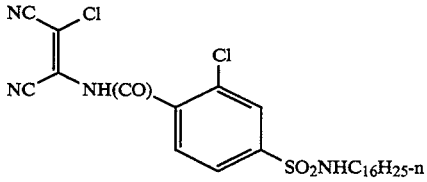
C-180
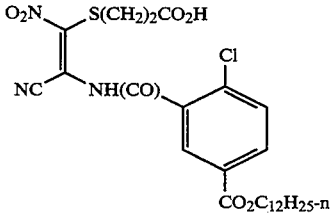
C-181
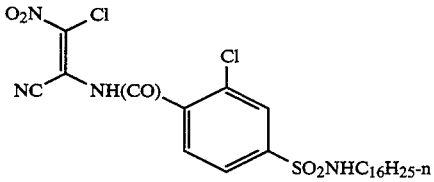
C-182
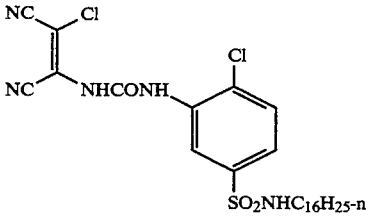
C-183
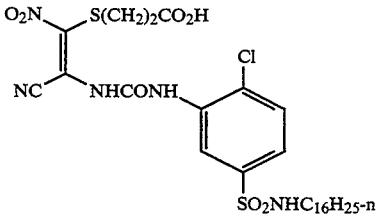
C-184
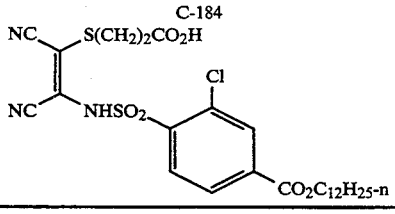
C-185
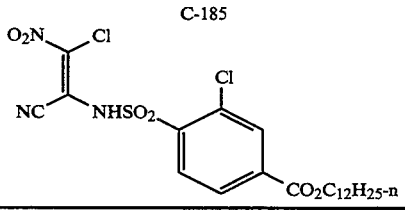

Couplers 53 to 55 above form yellow image dyes whereas the rest all form magenta image dyes.

The present colour couplers may be prepared by the following general scheme:

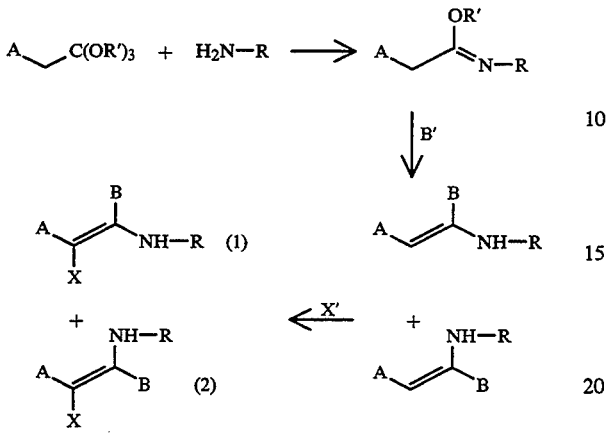

in which B′ may be an anionic or neutral species and X′ may be an anionic, neutral or cationic species.

The color couplers described above which are used in the elements of this invention, can be used in any of the ways and in any of the combinations in which couplers are used in the photographic art. Typically, the coupler is incorporated in a silver halide emulsion and the emulsion coated on a support to form part of a photographic element. Alternatively, the coupler can be incorporated at a location adjacent to the silver halide emulsion where, during development, the coupler will be in reactive association with development products such as oxidized color developing agent. Thus, as used herein, the term "associated" signifies that the coupler is in the silver halide emulsion layer or in an adjacent location where, during processing, the coupler is capable of reacting with silver halide development products.

For example, the magenta coupler used in the elements of the invention may be used to replace all or part of the magenta layer image coupler or may be added to one or more of the other layers in a color negative photographic element comprising a support bearing the following layers from top to bottom:

(1) one or more overcoat layers containing ultraviolet absorber(s);

(2) a two-coat yellow pack with a fast yellow layer containing "Coupler 1": Benzoic acid, 4-chloro-3-((2-(4-ethoxy-2,5-dioxo-3-(phenylmethyl)-1-imidazolidinyl)-3-(4-methoxyphenyl)-1,3-dioxo-propyl)amino)-, dodecyl ester and a slow yellow layer containing the same compound together with "Coupler 2": Propanoic acid, 2-[[5-[[4-[2-[[[2,4-bis(1,1-dimethylpropyl)phenoxy]acetyl]amino]-5[(2,2,3,3,4,4,4-heptafluoro-1-oxobutyl)amino]-4-hydroxyphenoxy]-2,3-dihydroxy-6-[(propylamino)carbonyl phenyl]thio]-1,3,4-thiadiazol-2-yl]thio]-, methyl ester and "Coupler 3": 1-((dodecyloxy)carbonyl) ethyl(3-chloro-4-((3-(2-chloro-4-((1-tridecanoylethoxy) carbonyl-)anilino)-3-oxo-2-((4)(5)(6)-(phenoxycarbonyl)-1H-benzotriazol-1-yl)propanoyl)amino))benzoate;

(3) an interlayer containing fine metallic silver;

(4) a triple-coat magenta pack with a fast magenta layer containing "Coupler 4": Benzamide, 3-((2(2,4-bis(1,1-dimethylpropyl)phenoxy)-1-oxobutyl)amino)-N-(4,5-dihydro-5-oxo-1-(2,4,6-trichlorophenyl)-1H-pyrazol-3-yl)-, "Coupler 5": Benzamide, 3-((2-(2,4-bis(1,1-dimethylpropyl)-phenoxy)-1-oxobutyl)amino)-N-(4′,5′-dihydro-5′-oxo-1′-(2,4,6-trichlorophenyl) (1,4′-bi-1H-pyrazol)-3′-yl)-, "Coupler 6": Carbamic acid, (6-(((3-(dodecyloxy)propyl) amino)carbonyl)-5-hydroxy-1-naphthalenyl)-, 2-methylpropyl ester , "Coupler 7": Acetic acid, ((2-((3-(((3-(dodecyloxy)propyl-)amino) carbonyl)-4-hydroxy-8-(((2-methylpropoxy)carbonyl) amino)-1-naphthalenyl)oxy)ethyl)thio)-, and "Coupler 8" Benzamide, 3-((2-(2,4-bis(1,1-dimethylpropyl) phenoxy)-1-oxobutyl)amino)-N-(4,5-dihydro-4-((4-methoxyphenyl) azo)-5-oxo-1-(2,4,6-trichlorophenyl)-1H-pyrazol-3-yl)-; a mid-magenta layer and a slow magenta layer each containing "Coupler 9": 2-Propenoic acid, butyl ester, styrene, 2:1:1 polymer with (N[1-(2,4,6-trichlorophenyl)-4,5-dihydro-5-oxo-1H-pyrazol-3-yl]-2-methyl-2-propenamide)$_2$ and "Coupler 10": Tetradecanamide, N-(4-chloro-3-((4-((4-((2,2-dimethyl-1-oxopropyl) amino)phenyl)azo)-4,5-dihydro-5-oxo-1-(2,4,6-trichlorophenyl)-1H-pyrazol-3-yl)amino)phenyl)-, in addition to Couplers 3 and 8;

(5) an interlayer;

(6) a triple-coat cyan pack with a fast cyan layer containing Couplers 6 and 7; a mid-cyan containing Coupler 6 and "Coupler 11": 2,7-Naphthalenedisulfonic acid, 5-(acetylamino)-3-((4-(2-((3-(((3-(2,4-bis(1,1-dimethylpropyl)phenoxy) propyl)amino)-carbonyl)-4-hydroxy-1-naphthalenyl) oxy)ethoxy)-phenyl)azo)-4-hydroxy-, disodium salt; and a slow cyan layer containing Couplers 2 and 6;

(7) an undercoat layer containing Coupler 8; and (8) an antihalation layer.

In a color paper format, the magenta coupler used in the elements of the invention may suitably be used to replace all or a part of the magenta coupler in a photographic element such as one comprising a support bearing the following from top to bottom:

(1) one or more overcoats;

(2) a cyan layer containing "Coupler 1": Butanamide, 2-(2,4-bis(1,1-dimethylpropyl)phenoxy)-N-(3,5-dichloro-2-hydroxy-4-methylphenyl)-, "Coupler 2": Acetamide, 2-(2,4-bis(1,1-dimethylpropyl)-phenoxy)-N-(3,5-dichloro-2-hydroxy-4-, and UV Stabilizers: Phenol, 2-(5-chloro-2H-benzotriazol-2-yl)-4,6-bis(1,1-dimethylethyl)-; Phenol, 2-(2H-benzotriazol-2-yl)-4-(1,1-dimethylethyl)-;Phenol, 2-(2H-benzotriazol-2-yl)-4-(1,1-dimethylethyl)-6 -(1-methylpropyl)-; and Phenol, 2-(2H-benzotriazol-2-yl )-4,6-bis(1,1-dimethylpropyl)- and a poly(t-butylacryl amide) dye stabilizer;

(3) an interlayer;

(4) a magenta layer containing "Coupler 3": Octanamide, 2-[2,4-bis(1,1-dimethylpropyl)phenoxy]-N-[2-(7-chloro-6-methyl-1H-pyrazolo[1,5-b][1,2,4]triazol-2-yl)propyl]- together with 1,1′-Spirobi(1H-indene), 2,2′,3,3′-tetrahydro-3,3,3′,3′-tetramethyl-5,5′,6,6′-tetrapropoxy-;

(5) an interlayer; and (6) a yellow layer containing "Coupler 4": 1-Imidazolidineacetamide, N-(5-((2-(2,4-bis(1,1-dimethylpropyl)phenoxy)-1-oxobutyl)amino)-2-chlorophenyl)-.alpha.-(2,2-dimethyl-1-oxopropyl)-4-ethoxy-2,5-dioxo-3-(phenylmethyl)-.

In a reversal medium, the magenta coupler used in the elements of the invention could be used to replace all or part of the magenta coupler in a photographic element such as one comprising a support and bearing the following layers from top to bottom:

(1) one or more overcoat layers;
(2) a nonsensitized silver halide containing layer;
(3) a triple-coat yellow layer pack with a fast yellow layer containing "Coupler 1": Benzoic acid, 4-(1-(((2-chloro-5-((dodecylsulfonyl)amino)phenyl) amino)carbonyl)-3,3-dimethyl-2-oxobutoxy)-, 1-methylethyl ester; a mid yellow layer containing Coupler 1 and "Coupler 2": Benzoic acid, 4-chloro-3-[[2-[4-ethoxy-2,5-dioxo-3-(phenylmethyl)-1-imidazolidinyl]-4,4-dimethyl-1,3-dioxopentyl]amino]-, dodecylester; and a slow yellow layer also containing Coupler 2;
(4) an interlayer;
(5) a layer of fine-grained silver;
(6) an interlayer;
(7) a triple-coated magenta pack with a fast magenta layer containing "Coupler 3": 2-Propenoic acid, butyl ester, polymer with N-[1-(2,5-dichlorophenyl)-4,5-dihydro-5-oxo-1H-pyrazol-3-yl]-2-methyl-2-propenamide; "Coupler 4": Benzamide, 3-((2-(2,4-bis(1,1-dimethylpropyl)phenoxy)-1-oxobutyl)amino)-N-(4,5-dihydro-5-oxo-1-(2,4,6-trichlorophenyl)-1H-pyrazol-3-yl)-; and "Coupler 5": Benzamide, 3-(((2,4-bis(1,1-dimethylpropyl)-phenoxy)acetyl)amino)-N-(4,5-dihydro-5-oxo-1-(2,4,6-trichlorophenyl)-1H-pyrazol-3-yl)-; and containing the stabilizer 1,1'-Spirobi(1-H-indene), 2,2',3,3'-tetrahydro-3,3,3',3'-tetramethyl-5,5',6,6'-tetrapropoxy-; and in the slow magenta layer Couplers 4 and 5 with the same stabilizer;
(8) one or more interlayers possibly including fine-grained nonsensitized silver halide;
(9) a triple-coated cyan pack with a fast cyan layer containing "Coupler 6": Tetradecanamide, 2-(2-cyanophenoxy)-N-(4-((2,2,3,3,4,4,4-heptafluoro-1-oxobutyl)amino)-3-hydroxyphenyl)-; a mid cyan containing "Coupler 7": Butanamide, N-(4-((2-(2,4-bis(1,1-dimethylpropyl)phenoxy)-1-oxobutyl-)amino)-2-hydroxyphenyl)-2,2,3,3,4,4,4-heptafluoro- and "Coupler 8": Hexanamide, 2-(2,4-bis(1,1-dimethylpropyl)phenoxy)-N-(4-((2,2,3,3,4,4,4-heptafluoro-1-oxobutyl)amino)-3-hydroxyphenyl)-;
(10) one or more interlayers possibly including fine-grained nonsensitized silver halide; and
(11) an antihalation layer.

It is common to include ballast or "BALL" substituents in the coupler. Representative BALL groups are of such size and configuration as to confer on the coupler molecule sufficient bulk to render the coupler substantially non-diffusible from the layer in which it is coated in the described photographic recording material.

Representative ballast groups include substituted or unsubstituted alkyl or aryl groups containing 8 to 40 carbon atoms.

Representative substituents on such groups include alkyl, aryl, alkoxy, aryloxy, alkylthio, hydroxy, halogen, alkoxycarbonyl, aryloxcarbonyl, carboxy, acyl, acyloxy, amino, anilino, carbonamido, carbamoyl, alkylsulfonyl, arysulfonyl, sulfonamido, and sulfamyl groups wherein the substituents typically contain 1 to 40 carbon atoms. Such substituents can also be further substituted.

As to the stabilizer, one or more of the below described stabilizers may be incorporated into the element in the same layer as the color coupler of formulae (1) or (2). Any of the particular embodiments of the stabilizer described below, may be used with any of the embodiments of the color coupler described above. While it has been found that stabilizers other than the acrylate or acrylamide stabilizers of the elements of the present invention, the acrylates and acrylamides produce lower fresh $D_{min}$ and hence the present invention is limited to the acrylate or acryalamide stabilizers. Such other stabilizers which could be used instead of acrylamides or acrylates, but are not included within the present invention, include styrene and alkyl substituted styrenes such as methylstyrene, dimethylystyrene, trimethylstyrene, ethylstyrene, n-propylstyrene, iso-propylstyrene, methoxystyrene, methoxy styrene, and n-butylstyrene. Any of the particular acrylate or acrylamide stabilizers described herein can be used with any of the color couplers of the elements of the present invention. It will also be appreciated that the stabilizers can be used in conjunction with other stabilizers, if desired, particularly those described in U.S. Patent Applications: PHOTOGRAPHIC ELEMENTS CONTAINING PARTICULAR COLOR COUPLERS IN COMBINATION WITH HYDROQUINONE TYPE STABILIZERS, Attorney Docket Number 65,269; PHOTOGRAPHIC ELEMENTS CONTAINING PARTICULAR COLOR COUPLERS IN COMBINATION WITH PARTICULAR STABILIZERS, Attorney Docket Number 65,254; PHOTOGRAPHIC ELEMENTS CONTAINING PARTICULAR COLOR COUPLERS IN COMBINATION WITH METAL COMPLEX STABILIZERS, Attorney Docket No. 65,270; all by Jain et al. and all filed on the same date as the present application. The foregoing applications are incorporated herein by reference.

As to particular embodiments of the acrylate or acrylamide stabilizers, such include those of formula (I) or (II):

(I)

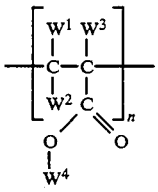

(II)

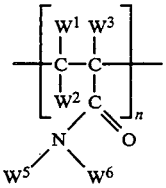

wherein:

$W^1$, $W^2$, $W^3$, $W^4$, $W^5$ and $W^6$ are, independently, an aliphatic, aromatic or heterocyclic group, any of which may be substituted or unsubstituted, or hydrogen or halogen.

Particularly, $W^1$, $W^2$, $W^3$, $W^4$, $W^5$ and $W^6$ have no more than 10 carbon atoms and may independently be alkyl, aryl or heterocyclic, any of which may be substituted or unsubstituted, or may be hydrogen or halogen (such as chlorine or bromine). Preferably, and $W^2$ are hydrogen. The molecular weight of the stabilizer is preferably between about 1,000 and 150,000, with about 7,000 to 25,000 being most preferred. Typical levels of the stabilizer in the layer containing the color coupler dispersion of the type required by the present invention, are 0.1 to 3.0 gram per gram of coupler, preferably 0.3 to 1.0 gram per gram of coupler.

Particular examples of stabilizers required for elements of the present invention include vinyl polymers of acrylic acid amides such as acrylamide, methylacrylamide, ethylacrylamide, iso-propylacrylamide, n-propylacrylamide, n-butylacrylamide, iso-butylacrylamide, sec-butylacrylamide, tert-butylacrylamide, tert-octylacrylamide, cyclohexylacrylamide, benzylacrylamide, and phenylacrylamide.

Also included within the stabilizers required for elements of the present invention are vinyl polymers of acrylic acid esters such as methyl acrylate, ethyl acrylate, n-propyl acrylate, iso-propyl acrylate, n-butyl acrylate, isobutyl acrylate, sec-butyl acrylate, tert-butyl acrylate, amyl acrylate, hexyl acrylate, 2-ethylhexyl acrylate, octyl acrylate, tert-octyl acrylate, cyclohexyl acrylate, furfuryl acrylate, 2-isopropoxy acrylate, tetrahydrofurfurly acrylate, phenyl acrylate, benzyl acrylate, cresyl acrylate, anisyl acrylate, and naphthyl acrylate. Other polymers for use in this invention are formed from the following monomers: methacrylic acid esters such as methyl methacrylate, ethyl methacrylate, n-propyl methacrylate, isopropyl methacrylate, n-butyl methacrylate, isobutyl methacrylate, sec-butyl methacrylate, tert-butyl methacrylate, amyl methacrylate, hexyl methacrylate, 2-ethylhexyl methacrylate, octyl methacrylate, tert-octyl methacrylate, cyclohexyl methacrylate, stearyl methacrylate, furfuryl methacrylate, tetrahydrofurfurly methacrylate, phenyl methacrylate, benzyl methacrylate, cresyl methacrylate, and naphthyl methacrylate.

The photographic elements can be single color elements or multicolor elements. Multicolor elements contain dye image-forming units sensitive to each of the three primary regions of the spectrum. Each unit can be comprised of a single emulsion layer or of multiple emulsion layers sensitive to a given region of the spectrum. The layers of the element, including the layers of the image-forming units, can be arranged in various orders as known in the art. In a alternative format, the emulsions sensitive to each of the three primary regions of the spectrum can be disposed as a single segmented layer.

A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler, at least one of the couplers in the element being a coupler of the type described above for elements of this invention. The element can contain additional layers, such as filter layers, interlayers, overcoat layers, subbing layers, and the like.

In the following discussion of suitable materials for use in elements of this invention, reference will be made to *Research Disclosure,* December 1989, Item 308119, published by Kenneth Mason Publications, Ltd., Dudley Annex, 12a North Street, Emsworth, Hampshire P010 7DQ, ENGLAND, which will be identified hereafter by the term "Research Disclosure." The contents of the Research Disclosure, including the patents and publications referenced therein, are incorporated herein by reference, and the Sections hereafter referred to are Sections of the Research Disclosure.

The silver halide emulsions employed in the elements of this invention can be either negative-working or positive-working. Suitable emulsions and their preparation as well as methods of chemical and spectral sensitization are described in Sections I through IV. Color materials and development modifiers are described in Sections V and XXI. Vehicles are described in Section IX, and various additives such as brighteners, antifoggants, stabilizers, light absorbing and scattering materials, hardeners, coating aids, plasticizers, lubricants and matting agents are described , for example, in Sections V, VI, VIII, X, XI, XII, and XVI. Manufacturing methods are described in Sections XIV and XV, other layers and supports in Sections XIII and XVII, processing methods and agents in Sections XIX and XX, and exposure alternatives in Section XVIII.

Preferred color developing agents are p-phenylenediamines. Especially preferred are:

4-amino N,N-diethylaniline hydrochloride,
4-amino-3-methyl-N,N-diethylaniline hydrochloride,
4-amino-3-methyl-N-ethyl-N-(b-(methanesulfonamido) ethyl)aniline sesquisulfate hydrate,
4-amino-3-methyl-N-ethyl-N-(b-hydroxyethyl)aniline sulfate,
4-amino-3-b-(methanesulfonamido)ethyl-N,N-diethylaniline hydrochloride and
4-amino-N-ethyl-N-(2-methoxyethyl)-m-toluidine di-p-toluene sulfonic acid.

With negative working silver halide a negative image can be formed. Optionally positive (or reversal) image can be formed.

The magenta coupler described herein may be used in combination with other classes of magenta image couplers such as 3-acylamino-5-pyrazolones and heterocyclic couplers (e.g. pyrazoloazoles) such as those described in EP 285,274; U.S. Pat. No. 4,540,654; EP 119,860, or with other 5-pyrazolone couplers containing different ballasts or coupling-off groups such as those described in U.S. Pat. No. 4,301,235; U.S. Pat. No. 4,853,319 and U.S. Pat. No. 4,351,897. The coupler may also be used in association with yellow or cyan colored couplers (e.g. to adjust levels of interlayer correction) and with masking couplers such as those described in EP 213.490; Japanese Published Application 58-172,647; U.S. Pat. No. 2,983,608; German Application DE 2,706,117C; U.K. Patent 1,530,272; Japanese Application A-113935; U.S. Pat. No. 4,070,191 and German Application DE 2,643,965. The masking couplers may be shifted or blocked.

The couplers may also be used in association with materials that accelerate or otherwise modify the processing steps e.g. of bleaching or fixing to improve the quality of the image. Bleach accelerators described in EP 193,389; EP 301,477; U.S. Pat. No. 4,163,669; U.S. Pat. No. 4,865,956; and U.S. Pat. No. 4,923,784 are particularly useful. Also contemplated is use of the coupler in association with nucleating agents, development accelerators or their precursors (UK Patent 2,097,140; U.K. Patent 2,131,188); electron transfer agents (U.S. Pat. No. 4,859,578; U.S. Pat. No. 4,912,025); antifogging and anti colormixing agents such as derivatives of hydroquinones, aminophenols, amines, gallic acid; catechol; ascorbic acid; hydrazides; sulfonamidophenols; and non color-forming couplers.

The couplers may also be used in combination with filter dye layers comprising colloidal silver sol or yellow and/or magenta filter dyes, either as oil-in-water dispersions, latex dispersions or as solid particle dispersions. Additionally, they may be used with "smearing" couplers (e.g. as described in U.S. Pat. No. 4,366,237; EP 96,570; U.S. Pat. No. 4,420,556; and U.S. Pat. No. 4,543,323.) Also, the couplers may be blocked or coated in protected form as described, for example, in Japanese Application 61/258,249 or U.S. Pat. No. 5,019,492.

The coupler may further be used in combination with image-modifying compounds such as "Developer Inhibitor-Releasing" compounds (DIR's). DIR's useful in conjunction with the color couplers useful in the invention, are known in the art and examples are described in U.S. Pat. Nos. 3,13 7,578; 3,148,022; 3,148,062; 3,227,554; 3,384,657; 3,379,529; 3,615,506; 3,617,291; 3,620,746; 3,701,783; 3,733,201; 4,049,455; 4,095,984; 4,126,459; 4,149,886; 4,150,228; 4,211,562; 4,248,962; 4,259,437; 4,362,878; 4,409,323; 4,477,563; 4,782,012; 4,962,018; 4,500,634; 4,579,816; 4,607,004; 4,618,571 4,678,739; 4,746,600; 4,746,601; 4,791,049; 4,857,447 4,865,959; 4,880,342; 4,886,736; 4,937,179; 4,946,767 4,948,716; 4,952,485; 4,956,269; 4,959,299; 4,966,835 4,985,336 as well as in patent publications GB 1,56 0,240; GB 2,007,662; GB 2,032,914; GB 2,099,167; DE 2,8 42,063, DE 2,937,127; DE 3,636,824; DE 3,644,416 as well as the following European Patent Publications: 272,5 73; 335,319; 336,411; 346, 899; 362, 870; 365,252; 3 65,346; 373,382; 376,212; 377,463; 8,236; 384,670; 396,486; 401,612; 401,613.

Such compounds are also disclosed in "Developer-Inhibitor-Releasing (DIR) Couplers for Color Photography," C. R. Barr, J. R. Thirtle and P. W. Vittum in Photographic Science and Engineering, Vol. 13, p. 174 (1969), incorporated herein by reference. Generally, the developer inhibitor-releasing (DIR) couplers include a coupler moiety and an inhibitor coupling-off moiety (IN). The inhibitor-releasing couplers may be of the time-delayed type (DIAR couplers) which also include a timing moiety or chemical switch which produces a delayed release of inhibitor. Examples of typical inhibitor moieties are: oxazoles, thiazoles, diazoles, triazoles, oxadiazoles, thiadiazoles, oxathiazoles, thiatriazoles, benzotriazoles, tetrazoles, benzimidazoles, indazoles, isoindazoles, mercaptotetrazoles, selenotetrazoles, mercaptobenzothiazoles, selenobenzothiazoles, mercaptobenzoxazoles, selenobenzoxazoles, mercaptobenzimidazoles, selenobenzimidazoles, benzodiazoles, mercaptooxazoles, mercaptothiadiazoles, mercaptothiazoles, mercaptotriazoles, mercaptooxadiazoles, mercaptodiazoles, mercaptooxathiazoles, telleurotetrazoles or benzisodiazoles. In a preferred embodiment, the inhibitor moiety or group is selected from the following formulas:

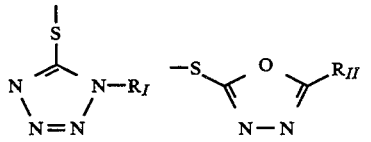

-continued

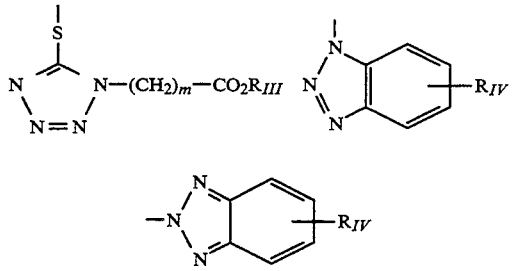

wherein $R_I$ is selected from the group consisting of straight and branched alkyls of from 1 to about 8 carbon atoms, benzyl and phenyl groups and said groups containing at least one alkoxy substituent; $R_{II}$ is selected from $R_I$ and —$SR_I$; $R_{III}$ is a straight or branched alkyl group of from 1 to about 5 carbon atoms and m is from 1 to 3; and $R_{IV}$ is selected from the group consisting of hydrogen, halogens and alkoxy, phenyl and carbonamido groups, —$COOR_V$ and —$NHCOOR_V$ wherein $R_V$ is selected from substituted and unsubstituted alkyl and aryl groups.

Although it is typical that the coupler moiety included in the developer inhibitor-releasing coupler forms an image dye corresponding to the layer in which it is located, it may also form a different color as one associated with a different film layer. It may also be useful that the coupler moiety included in the developer inhibitor-releasing coupler forms colorless products and/or products that wash out of the photographic material during processing (so-called "universal" couplers).

As mentioned, the developer inhibitor-releasing coupler may include a timing group which produces the time-delayed release of the inhibitor group such as groups utilizing the cleavage reaction of a hemiacetal (U.S. Pat. No. 4,146,396, Japanese Applications 60-249148; 60-249149); groups using an intramolecular nucleophilic substitution reaction (U.S. Pat. No. 4,248,962); groups utilizing an electron transfer reaction along a conjugated system (U.S. Pat. Nos. 4,409,323; 4,421,845; Japanese Applications 57-188035; 58-98728; 58-209736; 58-209738) groups utilizing ester hydrolysis (German Patent Application (OLS) No. 2,626,315; groups utilizing the cleavage of imino ketals (U.S. Pat. No. 4,546,073); groups that function as a coupler or reducing agent after the coupler reaction (U.S. Pat. No. 4,438,193; U.S. Pat. No. 4,618,571) and groups that combine the features describe above. It is typical that the timing group or moiety is of one of the formulas:

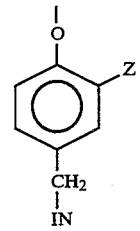

-continued

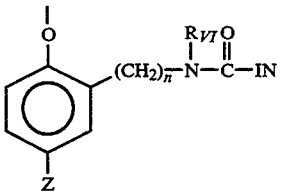

wherein IN is the inhibitor moiety, Z is selected from the group consisting of nitro, cyano, alkylsulfonyl; sulfamoyl ($—SO_2NR_2$); and sulfonamido ($—NRSO_2R$) groups; n is 0 or 1; and $R_{VI}$ is selected from the group consisting of substituted and unsubstituted alkyl and phenyl groups. The oxygen atom of each timing group is bonded to the coupling-off position of the respective coupler moiety of the DIAR.

Suitable developer inhibitor-releasing couplers for use in the elements of the present invention include, but are not limited to, the following:

D1

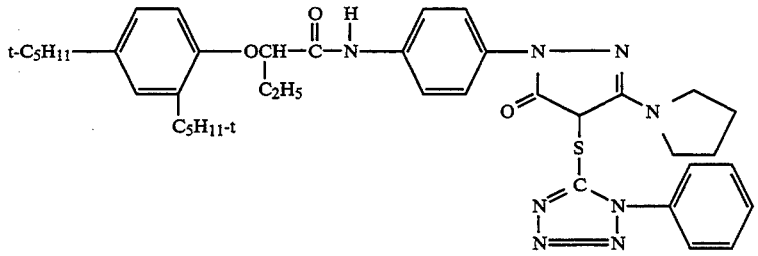

D2

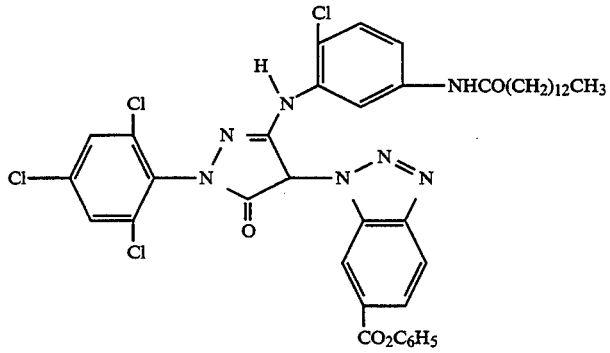

D3

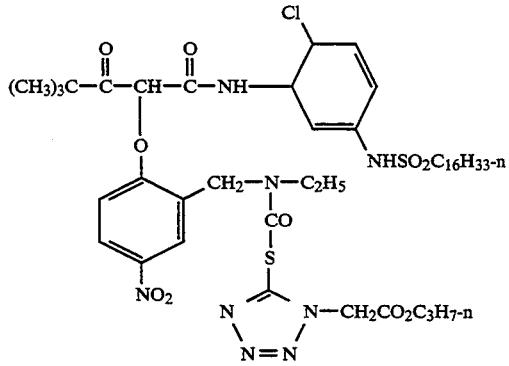

D4

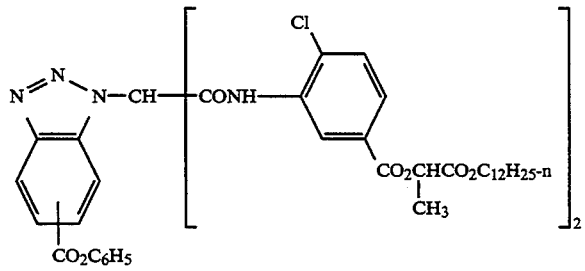

-continued
D5
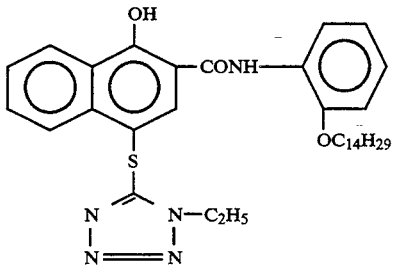
D6
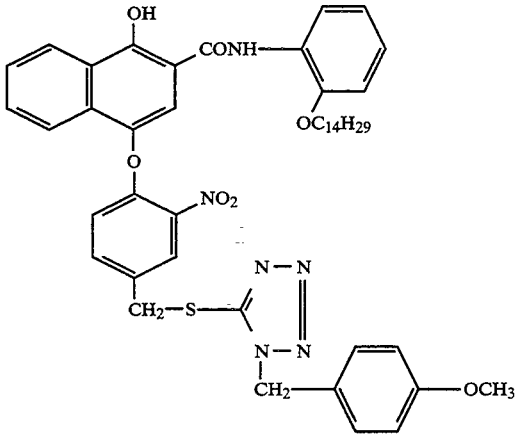
D7
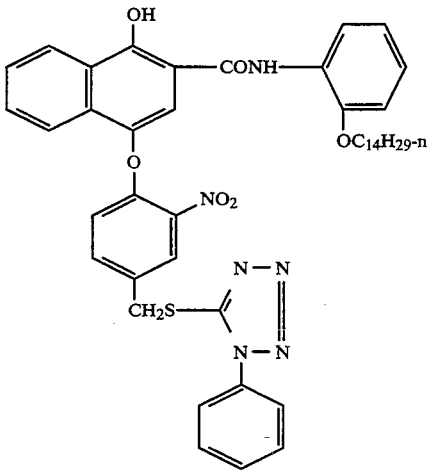
D8
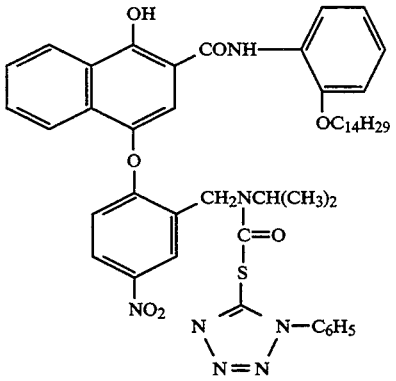
It is also contemplated that the concepts of the present invention may be employed to obtain reflection color prints as described in Research Disclosure, November 1979, Item 18716, available from Kenneth Mason Publications, Ltd, Dudley Annex, 12a North Street, Emsworth, Hampshire P0101 7DQ, England, incorporated herein by reference. The emulsions and materials to form elements of the present invention, may be coated on pH adjusted support as described in U.S. Pat. No. 4,917,994; with epoxy solvents (EP 0 164 961); with nickel complex stabilizers (U.S. Pat. No. 4,346,165; U.S. Pat. No. 4,540,653 and U.S. Pat. No. 4,906,559 for example); with ballasted chelating agents such as those in U.S. Pat. No. 4,994,359 to reduce sensitivity to polyvalent cations such as calcium; and with stain reducing compounds such as described in U.S. Pat. No. 5,068,171 and U.S. Pat. No. 5,096,805. Other compounds useful in the elements of the invention are disclosed in Japanese Published Applications 83-09,959; 83-62,586; 90-072,629, 90-072,630; 90-072,632; 90-072,633; 90-072,634; 90-077,822; 90-078,229; 90-078,230; 90-079,336; 90-079,338; 90-079,690; 90-079,691; 90-080,487; 90-080,489; 90-080,490; 90-080,491; 90-080,492; 90-080,494; 90-085,928; 90-086,669; 90-086,670; 90-087,361; 90-087,362; 90-087,363; 90-087,364; 90-088,096; 90-088,097; 90-093,662; 90-093,663; 90-093,664; 90-093,665; 90-093,666; 90-093,668; 90-094,055; 90-094,056; 90-101,937; 90-103,409; 90-151,577.

Especially useful in this invention are tabular grain silver halide emulsions. Specifically contemplated tabular grain emulsions are those in which greater than 50 percent of the total projected area of the emulsion grains are accounted for by tabular grains having a thickness of less than 0.3 micron (0.5 micron for blue sensitive emulsion) and an average tabularity (T) of greater than 25 (preferably greater than 100), where the term "tabularity" is employed in its art recognized usage as $$T=ECD/t^2$$

where

ECD is the average equivalent circular diameter of the tabular grains in microns and t is the average thickness in microns of the tabular grains.

The average useful ECD of photographic emulsions can range up to about 10 microns, although in practice emulsion ECD's seldom exceed about 4 microns. Since both photographic speed and granularity increase with increasing ECD's, it is generally preferred to employ the smallest tabular grain ECD's compatible with achieving aim speed requirements.

Emulsion tabularity increases markedly with reductions in tabular grain thickness. It is generally preferred that aim tabular grain projected areas be satisfied by thin ($t<0.2$ micron) tabular grains. To achieve the lowest levels of granularity it is preferred to that aim tabular grain projected areas be satisfied with ultrathin ($t<0.06$ micron) tabular grains. Tabular grain thicknesses typically range down to about 0.02 micron. However, still lower tabular grain thicknesses are contemplated. For example, Daubendiek et al U.S. Pat. No. 4,672,027 reports a 3 mole percent iodide tabular grain silver bromoiodide emulsion having a grain thickness of 0.017 micron.

As noted above tabular grains of less than the specified thickness account for at least 50 percent of the total grain projected area of the emulsion. To maximize the advantages of high tabularity it is generally preferred that tabular grains satisfying the stated thickness criterion account for the highest conveniently attainable percentage of the total grain projected area of the emulsion. For example, in preferred emulsions tabular grains satisfying the stated thickness criteria above account for at least 70 percent of the total grain projected area. In the highest performance tabular grain emulsions tabular grains satisfying the thickness criteria above account for at least 90 percent of total grain projected area.

Suitable tabular grain emulsions can be selected from among a variety of conventional teachings, such as those of the following: Research Disclosure, Item 22534, January 1983, published by Kenneth Mason Publications, Ltd., Emsworth, Hampshire P010 7DD, England; U.S. Pat. Nos. 4,439,520; 4,414,310; 4,433,048; 4,643,966; 4,647,528; 4,665,012; 4,672,027; 4,678,745; 4,693,964; 4,713,320; 4,722,886; 4,755,456; 4,775,617; 4,797,354; 4,801,522; 4,806,461; 4,835,095; 4,853,322; 4,914,014; 4,962,015; 4,985,350; 5,061,069 and 5,061,616.

The photographic elements can be single colour elements or multicolour elements. In a multicolour element, the dye-forming color couplers used in this invention which provide magenta dyes, would usually be associated with a green-sensitive emulsion, although they could be associated with an emulsion sensitised to a different region of the spectrum, or with a panchromatically sensitised, orthochromatically sensitised or unsensitised emulsion. Multicolour elements contain dye image-forming units sensitive to each of the three primary regions of the spectrum. Each unit can be comprised of a single emulsion layer or of multiple emulsion layers sensitive to a given region of the spectrum. The layers of the element, including the layers of the image-forming units, can be arranged in various orders as known in the art.

A typical multicolour photographic element comprises a support bearing yellow, magenta and cyan dye image-forming units comprising at least one blue-, green- or red-sensitive silver halide emulsion layer having associated therewith at least one yellow, magenta or cyan dye-forming coupler respectively, at least one of the dye-forming couplers being a coupler of the type described above as useful in this invention. The element can contain additional layers, such as filter and barrier layers.

Photographic elements of the present invention may also usefully include a magnetic recording material as described in *Research Disclosure,* Item 34390, November 1992.

The following Preparative Examples 1 and 2 illustrate preparation of color couplers as used in photographic elements of the present invention. Examples 1 to 5 below illustrate the beneficial properties of such color couplers. The examples after Example 5 illustrate elements of the present invention and show the advantageous stabilization provided by the class of stabilizers described above in combination with the class of color couplers described above.

PREPARATIVE EXAMPLE 1

Compound C-1 of Table 1 is prepared by a four-step synthesis and synthetic details for it and all intermediates are provided below. The preparation is illustrated by the following sequence.

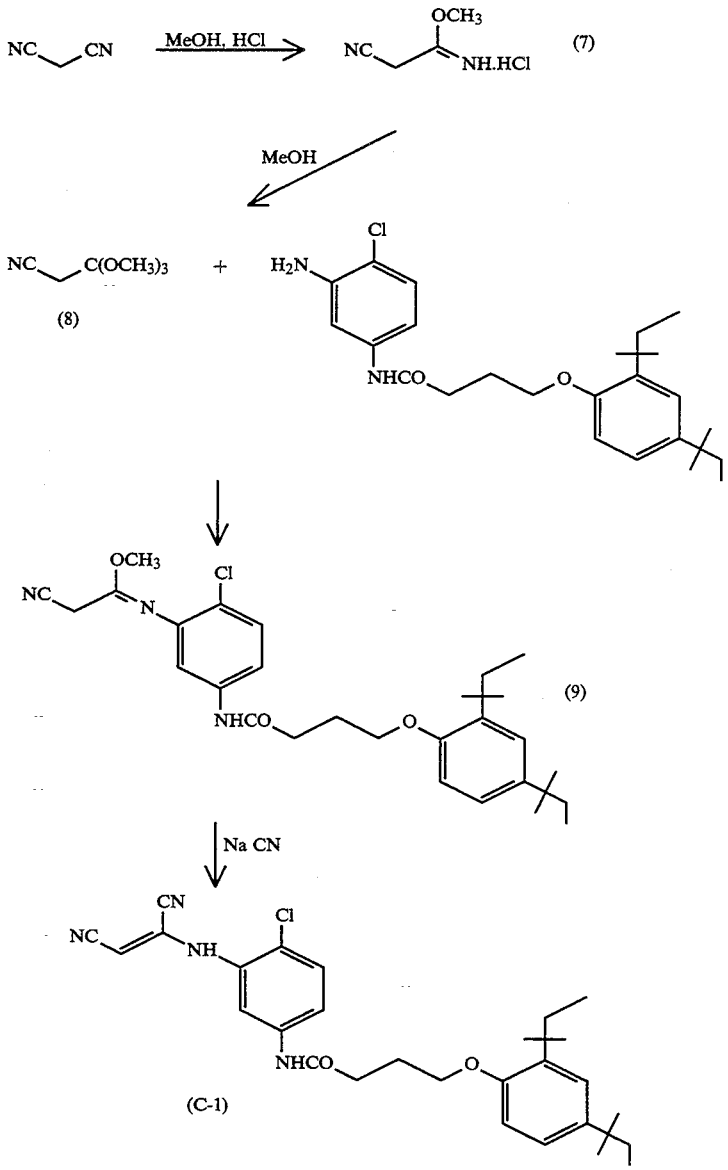

Methyl Cyanoacetimidate Hydrochloride (7)

A solution of malononitrile (66 g; 1 mole) in diethyl ether (500 ml) and methanol (44 g; 1.38 mole) was cooled to 0° C. by means of an ice-salt bath. The solution was well stirred and hydrogen chloride bubbled through it for 1 h. On standing at 0° C. overnight the product crystallised as a white solid. This was filtered, washed with diethyl ether and allowed to dry to afford the imidate hydrochloride as white crystals (100.6 g; 75% yield). The product was used without characterisation in the preparation of trimethyl ortho-cyanoacetate.

Trimethyl ortho-cyanoacetate (8)

The methyl imidate ester hydrochloride salt was added to methanol (1.01) and stirred at room temperature for 18 h. Precipitated ammonium chloride was removed by filtration and the filtrate evaporated to dryness. The residue was partitioned between ether (900 ml) and a saturated sodium carbonate solution (300 ml). The organic layer was separated, dried over magnesium sulphate and filtered. Removal of the ether in vacuo gave the orthoester as a pale yellow oil (75 g; 69%). The product was shown to be pure by NMR spectroscopy [2.86 (2H, s, NC—$CH_2$) and 3.36 (9H, s, OMe)] and used without further characterisation.

Compound (9)

Trimethyl ortho-cyanoacetate (14.5 g; 100 mmole) and the aniline (33.3 g; 75 mmole) were mixed together in a round-bottom flask and heated by means of an oil bath at a temperature of 130°-140° C. When all of the aniline had melted so that the reaction comprised a mobile liquid, a catalytic amount of p-toluene sulphonic acid was added. This caused the reaction mixture to bubble and methanol to distill from the open flask. Heating was continued for a further 40 minutes then suction was applied to the reaction vessel by means of a water pump for 5 minutes more. The reaction mixture was opened to the air and allowed to cool to room temperature to leave a brown gum which was then dissolved in hot methanol (100 ml). On stirring the solution at ice-bath temperature, a cream coloured solid crystallised. This was filtered and dried under suction to give the pure imidate product as an amorphous solid (30.34 g; 77%).

| $C_{30}H_{40}ClN_3O_3$ | % C | H | Cl | N |
|---|---|---|---|---|
| requires: | 68.5 | 7.6 | 6.8 | 8.0 |
| found: | 68.4 | 7.7 | 6.75 | 8.0 |

Compound C-1

To a solution of 5.3 g (10 mmole) compound 9 obtained above in water (5 ml) and DMF (75 ml) was added sodium cyanide (1 g; 20 mmole). The mixture was allowed to stir at room temperature for 4 hours then it was warmed gently by means of a steam bath for 2 hours. The solution was then allowed to cool before being poured onto 1.51 of brine into which had been dissolved 15 ml of concentrated hydrochloric acid. The brown precipitate was extracted into ethyl acetate and washed with brine. The organic layer was separated, dried with anhydrous magnesium sulphate, and filtered. The solvents were removed under reduced pressure to leave a brown gum. Column chromatography using ethyl acetate : 60–80 petrol in the ratio of 1:3 gave impure product as a pale yellow solid (4.8 g). Pure product was obtained as a cream coloured solid (4 g; 77%) by trituration with a mixture of ethyl acetate and 60–80 petrol. The product exhibited satisfactory mass and proton NMR spectra.

| $C_{30}H_{37}ClN_4O_2$ | % C | H | Cl | N |
|---|---|---|---|---|
| requires: | 69.1 | 7.2 | 6.8 | 10.75 |
| found: | 69.1 | 7.5 | 6.8 | 10.6 |

PREPARATIVE EXAMPLE 2

Compound C-50 of Table 1 is prepared from compound C-1 by a two step synthesis and synthetic details for it are provided below.

Compound C-50

Sulphuryl chloride (1.61 g; 12 mmol) was added dropwise to a solution of 1-phenyl-1H-tetrazole-5-thiol (1.96 g; 11 mmol) in dry dichloromethane (100 ml) and the resulting mixture stirred at room temperature for 3 hours. After this time the solvents were removed under reduced pressure to leave a brown oil. This was dissolved in dry dimethylformamide (10 ml) then added rapidly to a solution of compound C-1 (5.21 g; 10 mmol) in dimethylformamide (50 ml). The resulting solution was stirred at room temperature for 18 hours before being poured onto dilute hydrochloric acid (40 ml of c.HCl in 31 of water) to precipitate a pale yellow solid. The solid was extracted into ethyl acetate and washed with brine; the organic layer was separated, dried with anhydrous magnesium sulphate, filtered then the solvents were removed under reduced pressure to leave the crude product as a yellow solid (6.96 g). Pure product (5.2 g, 75%) was obtained from this as a pale yellow solid by column chromatography using silica-gel (63–200 mesh) as the solid support and ethyl acetate and 60–80 petroleum, in the ratio of 1:2, as eluent. The product exhibited satisfactory mass and proton NMR spectroscopy.

| $C_{37}H_{41}ClN_8O_2S$ | % C | H | Cl | N | S |
|---|---|---|---|---|---|
| requires: | 63.7 | 5.9 | 5.0 | 16.1 | 4.6 |
| found: | 63.1 | 6.0 | 4.7 | 16.1 | 4.4 |

Compound C-52

Compound C-52 of Table 1 was prepared from C-51 in a one-step synthesis and the synthetic details are provided below.

A solution of sulphuryl chloride (2.43 g; 18 mmol) in dichloromethane (50 ml) was added to a solution of compound C-51 (7.83 g; 18 mmol) in dichloromethane (100 ml) over 30 minutes. The resulting pale yellow solution was stirred at room temperature for 1 hour before the solvents were removed under reduced pressure to leave the crude product as a yellow oil. Trituration of this with ethyl acetate and 60–80 petroleum in the ratio of 1:100 afforded pure product as a cream coloured solid (4.59 g; 54%). The product exhibited satisfactory mass and proton NMR spectra.

| $C_{22}H_{29}C_{12}N_3O_2S$ | % C | H | Cl | N | S |
|---|---|---|---|---|---|
| requires: | 56.2 | 6.2 | 15.1 | 8.9 | 6.8 |
| found: | 56.2 | 6.3 | 15.0 | 8.9 | 6.55 |

Example 1—Dye Image Properties

The compounds C-1 to C-6 useful in elements of the present invention, and control compounds 1–3 were incorporated into a photographic silver bromoiodide emulsion and coated in the following format:

| | | |
|---|---|---|
| Gel Supercoat | gelatin | 1.50 g/m$^2$ |
| Emulsion Layer | Silver bromoiodide | 1.60 g/m$^2$ |
| Coupler | | 1.04 mmol/m$^2$ |
| Gelatin | | 2.42 g/m$^2$ |
| Bis (vinylsulphonyl)-methane (hardener) | | 0.06 g/m$^2$ |
| Support | Cellulose acetate | |

Control compounds 1–3 had the following formulae:

CONTROL 1

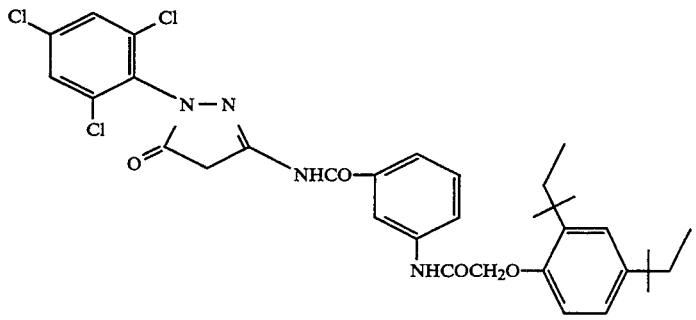

CONTROL 2

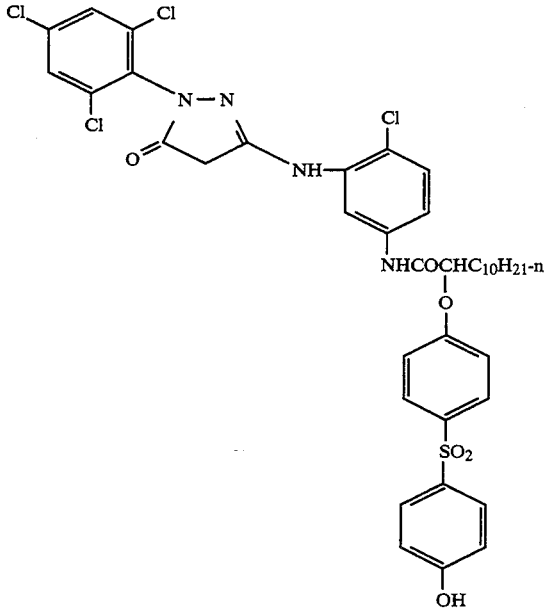

CONTROL 3

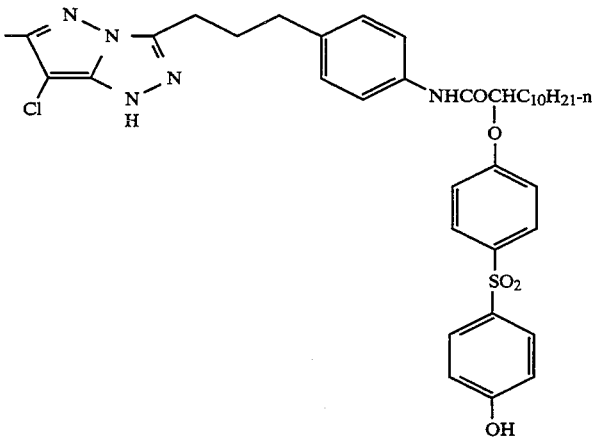

The coupler dispersion used contained 6% w/w gelatin, 8.8% coupler and coupler solvents in the ratio:- coupler: tricresyl phosphate: 2-(2-butoxyethoxy)ethyl acetate 1: 0.5: 1.5.

The experimental photographic coatings prepared in this way are slit and chopped into 35mm test strips. These are exposed through a 0–4.0 neutral density step wedge (0.2 ND step increments) and Daylight V, Wratten 9 filters then processed through the following the C-41 process described in British Journal of Photography (1988) 196-198:

| | |
|---|---|
| Developer | 2.5 minutes |
| Bleach | 4.0 minutes |
| Wash | 2.0 minutes |
| Fix | 4.0 minutes |
| Wash | 2.0 minutes |

For each test strip, step-wedge densities are measured using a Macbeth TD/504/Hewlett Packard 85 automatic transmission densitometer. Measurements of minimum density (Dmin), maximum density (Dmax) and contrast (gamma) are calculated from the D log E curves.

The results are shown in Table 4 below.

TABLE 4

| Compound | $D_{min}$ | $D_{max}$ | $\lambda_{max}$nm | HBW nm |
|---|---|---|---|---|
| Control 1 | 0.18 | 2.52 | 555.5 | 96.0 |
| Control 2 | 0.30 | 2.75 | 547.5 | 94.5 |
| Control 3 | 0.15 | 2.68 | 553.3 | 90.5 |
| C-1 | 0.19 | 2.22 | 549.0 | 92.0 |
| C-2 | 0.31 | 3.36 | 550.0 | 95.0 |
| C-3 | 0.40 | 2.93 | 555.0 | 100.0 |
| C-4 | 0.22 | 2.48 | 552.5 | 92.0 |
| C-5 | 0.27 | 1.85 | 549.0 | 101.0 |
| C-6 | 0.22 | 1.14 | 552.0 | 106.0 |
| C-45 | 0.16 | 2.64 | 546.0 | 87.0 |

The results presented in Table 4 for the $\lambda_{max}$ and half-band width values show that compounds C-1 to C-6 produce dyes of similarly desirable absorption characteristics as each of the control couplers. However the dyes from compounds C-1 to C-6 show much less secondary absorption in the blue region of the spectrum than the dyes from control pyrazolone couplers 1 or 2. This is similar to control compound 3 (a pyrazolotriazole). It is well recognised that a secondary absorption in the blue region is undesirable as it has an adverse effect on colour reproduction. Accordingly the use of compounds C-1 to C-6 in a photographic system offers advantages over the use of the control couplers 1 or 2.

The dye formed from coupler C-9 has an extinction coefficient of 50,000 in ethyl acetate and 52,000 in tricresyl phosphate. This is similar or higher than dyes formed from known magenta couplers.

FIG. 1 is a plot of absorbance vs wavelength for the dyes obtained from coupler C-3 and Control 1 (dotted line). It can be seen that the unwanted absorption of Control 1 in the 400–450 nm region is not present in the dye formed from coupler C-3.

The dyes from C-1 to C-6 show good light fastness and keeping properties when compared with the control couplers 1–3.

As judged by the values presented for $D_{max}$, the couplers C-1 to C-6 show a range of photographic activity which may be less than, equal to or greater than the activity shown by the control couplers. The availability of such a range of coupler activity implies that a coupler may be selected to best comply with the requirements of any particular photographic system.

The preparation of control 3 involves difficult methods of synthesis in a multi-step sequence within which product yields are often low. By contrast, the compounds C-1 to C-6 are easily obtained in high yield from readily available starting materials in a four-step sequence.

Example 2—Fastness Properties

The dye sample patches (density=1.0) are tested for light stability using the EDIE fadeometer for fade times of 100 h and 200 h accumulated fade. The spectrophotometric curves are remeasured after each fade period and the degree of fade quoted as the fractional decrease in density prior to fading.

Dark/wet stability is tested by incubating the yellow dye samples in a dark oven for periods of 1, 3 and 6 weeks at a constant 60° C. and 70% relative humidity. The spectrophotometric curves of the samples are then remeasured and once again the degree of fade is quoted as the fractional decrease in density at the absorption maximum (ΔD) relative to the initial density prior to fading. A positive value for dye fade indicates an increase in dye density.

Spectrophotometry has been chosen to monitor dye fade so that any subtle changes in curve shape as the dye fades will be apparent.

Typical EDIE fade results are shown below:

TABLE 5

| Compound | 100 hrs | 200 hrs |
|---|---|---|
| C-6 | −0.34 | −0.58 |
| Control 3 | −0.43 | −0.65 |

Typical dark/wet fade results are shown below:

TABLE 6

| Compound | 1 week | 2 weeks | 3 weeks |
|---|---|---|---|
| C-6 | −0.05 | −0.14 | −0.23 |
| Control 1 | −0.34 | −0.36 | −0.38 |

In both tables the dyes formed from the color couplers of the described type for the invention, are shown to have light fastness as good as or better than Control 3 and dark/wet fade considerably better than Control 1.

Example 3—Variable $\lambda_{max}$ in coupler solvents

The dye obtained from coupler C-9 was dissolved in a number of solvent mixtures. The λmax and bandwidth of each solution was measured and the results recorded in the table below.

TABLE 7

| Solvent System | Ratio | $\lambda_{max}$ nm | Bandwidth nm |
|---|---|---|---|
| Cyclohexane:ethyl acetate | 9:1 | 520 | 73 |
| Diethyl ether:ethyl acetate | 9:1 | 525 | 72 |
| Methanol:ethyl acetate | 9:1 | 535 | 77 |
| Acetone:ethyl acetate | 9:1 | 537 | 77 |
| Dimethyl Sulphoxide | | 553 | 83 |
| Diethy lauramide:tricresyl phosphate | 9:1 | 544 | 73 |
| p-Dodecylphenol:tricresyl phosphate | 9:1 | 547 | 78 |

As can be seen, the $\lambda_{max}$ can be varied by choice of solvent while the bandwidth stays comparatively constant.

Example 4—Retouchability

The dye image of a number of the coatings described above was treated with a reducing solution to convert the dye to its leuco form which is relatively uncoloured. This is often the first step in the hand retouching of a photographic image. All samples showed considerable bleaching.

The reducing solution has the following composition:

| | |
|---|---|
| Stannous chloride | 10 g |
| Ethylenediamine tetraacetic acid.2Na | 1 g |
| Acetic acid | 20 ml |
| Water to | 200 ml |

Example 5—Formaldehyde Sensitivity

In-film resistance of the coupler to formaldehyde is measured by hanging unexposed test strips in a closed container in an atmosphere of formaldehyde generated from 10 g of paraformaldehyde. A controlled relative humidity is achieved using a water/glycerol mixture. Control strips are prepared by hanging similar strips in an identical closed container with the same humidity control but without the paraformaldehyde. After 48 hours the strips are removed from the respective containers, exposed and processed through the C-41 process as described above. The resistance of the coupler to formaldehyde is then calculated as a percentage density loss relative to the unfumed control. The results are shown in Table 8 below.

TABLE 8

| Dye from Coupler | % Density Loss |
|---|---|
| Control 1 | 90 |
| Control 2 | 97 |
| Control 3 | 0.5 |
| C-1 (4-equivalent) | 32.5 |
| C-45 (2-equivalent) | 0.5 |

The color couplers useful for the invention both show resistance to fading compared to two of the prior art dyes while the 2-equivalent coupler C-45 and Control 3 (a pyrazolotriazole coupler) show substantial immunity to fading by formaldehyde.

The compounds of formula Control 1 and C-50 were together incorporated into a photographic silver bromoiodide emulsion and coated in the following format:

| | | |
|---|---|---|
| Gel Supercoat | gelatin | 1.5 g/m$^2$ |
| Emulsion Layer | Silver bromoiodide | 0.8 g/m$^2$ |
| Control 1 | | 1.265 mmol/m$^2$ |
| Coupler C-50 | | (see Table 9 below) |
| Gelatin | | 2.42 g/m$^2$ |
| Bis (vinylsulphonyl)-methane (hardener) | | 0.06 g/m$^2$ |
| Support | Cellulose acetate | |

The coupler dispersion used for Control 1 contained 6% w/w gelatin, 8.8% coupler and coupler solvents in the ratio:- coupler: tricresyl phosphate: 2-(2-butoxyethoxy)ethyl acetate 1:0.5:1.5.

The coupler dispersion used for C-50 contained 12.5% w/w gelatin, 2.2% coupler and coupler solvents in the ratio:- C-50: tricresyl phosphate: 2-(2-butoxyethoxy)ethyl acetate 1:2:3.

The experimental photographic coatings prepared in this way are slit and chopped into 35 mm test strips. These are exposed through a 0–4.0 neutral density step wedge (0.2 ND step increments) and Daylight V, Wratten 9 filters then processed through the the C-41 process described in British Journal of Photography (1988) 196–198 as used above.

For each test strip, step-wedge densities are measured using a Macbeth TD/504/Hewlett Packard 85 automatic transmission densitometer. Measurements of maximum density (Dmax) and contrast (gamma) are calculated from the D log E curves The results from these measurements are shown in Table 9 below.

TABLE 9

| C-50 Laydown (mmol/m2) | D-max | Gamma |
|---|---|---|
| 0 | 2.22 | 1.51 |
| 0.06 | 2.07 | 1.19 |
| 0.12 | 1.89 | 1.11 |
| 0.24 | 1.63 | 0.97 |
| 0.36 | 1.47 | 0.91 |

The results show that both the $D_{max}$ and gamma of Control 1 are reduced as the level of C-50 within the emulsion layer is increased. Such a reduction in gamma and the corresponding loss in dye density clearly demonstrates that compound C-50 acts as a development inhibitor releasing coupler.

Example 6

Dispersions of the couplers were prepared in the following manner. In one vessel, 657 mg of a coupler (compound C-1 described above) of the type used in the present invention, 657 mg of a coupler solvent 2-ethylhexylphosphate, 328 mg of the stabilizer poly-tert-butylacrylamide ("PTBA"; molecular weight 10,000, and ethyl acetate were combined and warmed to dissolve. In a second vessel, gelatin, Alkanol XC TM (E.I. dupont Co.) and water were combined and passed three times through a Gaulin colloid mill. The ethyl acetate was removed by evaporation and water was added to restore the original weight after milling.

The photographic element of sample 3 was prepared by coating the following layers in the order listed below on a resin-coated paper support. The elements of the remainder of the sample were prepared in the same manner except that the amount of compound used as stabilizer was varied to obtain the level indicated in Table 10.

| | |
|---|---|
| 1st layer | |
| Gelatin | 300 mg/ft$^2$ |
| 2nd layer | |
| Gelatin | 150 mg/ft$^2$ |
| Coupler C-1 | 22 mg/ft$^2$ |
| Coupler solvent | 22 mg/ft$^2$ |
| Stabilizer (except as noted in Table 10) | 11 mg/ft$^2$ |
| Green sensitized AgCl emulsion | 26.5 mg/ft2 |
| 3rd layer | |
| Gelatin | 124 mg/ft2 |
| 2-(2H-benzotriazol-2-yl)-4,6-bis-(1,1-dimethylpropyl)phenol | 68 mg/ft$^2$ |
| Tinuvin 326 TM (Ciba-Geigy) | 12 mg/ft$^2$ |
| 4th layer | |
| Gelatin | 130 mg/ft$^2$ |
| Bis(vinylsulfonylmethyl) ether | 12.6 mg/ft$^2$ |

All of the photographic elements of the samples in Table 10 were given stepwise exposures to green light to provide various image dye densities including an area of no exposure to provide the fresh $D_{min}$ figures listed in Table 10, and processed as follows at 35 ° C.:

| | |
|---|---|
| Developer | 45 seconds |
| Bleach-Fix | 45 seconds |
| Wash (running water) | 1.5 minutes |

The developer and bleach-fix were of the following compositions:

| | |
|---|---|
| Developer | |
| Water | 700.00 mL |
| Triethanolamine | 12.41 g |
| Blankophor REU TM (Mobay Corp.) | 2.30 g |
| Lithium polystyrene sulfonate (30%) | 0.30 g |
| N,N-Diethylhydroxylamine (85%) | 5.40 g |
| Lithium sulfate | 2.70 g |
| N-{2-[(4-amino-3-methylphenyl) ethylamino]ethyl}methanesulfonamide sesquisulfate | 5.00 g |
| 1-Hydroxyethyl-1,1-diphosphonic acid (60%) | 0.81 g |

-continued

| | |
|---|---|
| Potassium carbonate, anhydrous | 21.16 g |
| Potassium chloride | 1.60 g |
| Potassium bromide | 7.00 mg |
| Water to make | 1.00 L |
| pH @ 26.7° C. adjusted to 10.04 +/− 0.05 | |
| Bleach-Fix | |
| Water | 700.00 mL |
| Solution of ammonium thiosulfate (54.4%) + ammonium sulfite (4%) | 127.40 g |
| Sodium metabisulfite | 10.00 g |
| Acetic acid (glacial) | 10.20 g |
| Solution of ammonium ferric ethylenediaminetetraacetate (44%) + ethylenediaminetetraacetic acid (3.5%) | 110.40 g |
| Water to make | 1.00 L |
| pH @ 26.7° C. adjusted to 5.5 +/− 0.1 | |

Magenta dyes were formed from coupler C-1 in each of the samples upon processing. The following photographic characteristics were determined: $D_{max}$ (the maximum density to green light); Speed (the relative log exposure required to yield a density to green light of 1.0); and Contrast (the ratio (S-T)/0.6, where S is the density at a log exposure 0.3 units greater than the Speed value and T is the density at a log exposure 0.3 units less than the Speed value. In each of the inventive samples in Table 10, no significant change in the foregoing parameters was seen between the same elements with or without stabilizer present.

The measured fresh $D_{min}$ (the minimun density toward blue light immediately following processing) values for each of the samples listed in Table 10 are provided in that table below. Elements of the present invention are indicated in Table 10 by an (I) while comparative elements are indicated by a (C).

TABLE 10

| Sample | Stabilizer | Fresh $D_{min}$ |
|---|---|---|
| 1 (C) | None | 0.125 |
| 2 (C) | polystyrene | 0.123 |
| 3 (I) | PTBA | 0.092 |

The invention has been described in detail with particular reference to preferred embodiments thereof, but it will be understood that variations and modifications can be effected within the spirit and scope of the invention.

What is claimed is:

1. A photographic element comprising a support, at least one photosensitive silver halide layer and associated therewith a color coupler and a stabilizer therefor which stabilizer is an acrylate or acrylamide homopolymer or copolymer of low water solubility, the coupler being of the general formula (1) or (2):

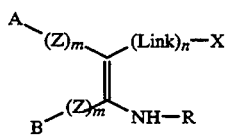

(1)

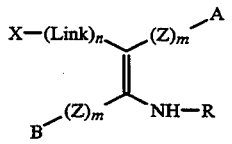

(2)

wherein A and B represent the same or different electron-withdrawing group,

X—(Link)$_n$— is H or a group which splits off from the carbon atom to which it is attached on coupling which may be substituted, —COR$^1$, —CSR$^1$, SOR$^1$, SO$_2$R$^1$, with oxidised color developer, R is an alkyl, cycloalkyl, aryl or heterocyclic —NHCOR$^1$, —CONHR$^1$, —COOR$^1$, —COSR$^1$, —NHSO$_2$R$^1$ wherein R$^1$ is an alkyl, cycloalkyl, or aryl group any of which are optionally substituted, and wherein two or more of B, R, and X optionally form part of a ring, and A does not form part of a ring with B, R, or X, Link is a linking group;

n is 0, 1 or 2 and

Z is a group that will extend the conjugated path from A or B to the —NH—R group while leaving the whole group electron-withdrawing, and has the formula:

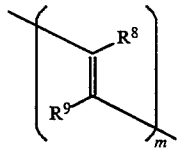

wherein R$^8$ and R$^9$ are each hydrogen, halogen, or an alkyl or aryl group that may be substituted, or R$^8$ and R$^9$ may complete a carbocyclic or heterocyclic ring, and m is 0, 1 or 2.

2. A photographic element as claimed in claim 1 in which the coupler contains a ballasting group of such size and configuration to render the coupler non-diffusible in the photographic material.

3. A photographic element as claimed in claim 1 in which the electron-withdrawing groups A and B each individually have a $\sigma_p$ value of at least 0.03.

4. A photographic element as claimed in claim 1 in which the electron-withdrawing groups A and B each individually have a $\sigma_p$ value of at least 0.35.

5. A photographic element as claimed in claim 1 or 2 in which the electron-withdrawing groups A and B each individually have a $\sigma_p$ value of 0.5 or above.

6. A photographic element as claimed in claim 1 in which groups A and B may each individually be a hydrogen, halogen, imido, —CN, —NO$_2$, —OR$^5$, —SR$^5$, —SO$_2$R$^1$, —OSO$_2$R$^1$, —SOR$^1$, —NHCOR$^5$, —CONHR$^1$, —OCONHR$^1$, —NHCO—OR$^1$, —SO$_2$NH—R$^1$, —NHSO$_2$R$^1$, —NHSO$_2$NHR$^1$, —NHNH—SO$_2$—R$^5$, —COOH, —COOR$^1$, —O—COR$^1$, —COR$^1$, —CSR$^1$, —CONHNHR$^1$, —CF$_3$, NHR$^5$, —NHR$^5$R$^{5'}$, or a silyloxy aryl aralkyl, alkyl, cycloalkyl, ureido, group having substituents such that the substituted group is electron-withdrawing, or an electron-withdrawing heterocycle, wherein R$^1$ is as defined in claim 1, R$^4$ is an alkyl, cycloalkyl, aryl or heterocyclic group any of which are optionally substituted and R$^5$ and R$^{5'}$ are each a substituted alkyl, cycloalkyl, aryl or heterocyclic group, and wherein the nature of the groups R$^1$ and R$^4$ and the substituents thereon are such that the group is electron-withdrawing.

7. A photographic element as claimed in claim 1 in which the color coupler is any of the following C-1 through C-185:
TABLE 3
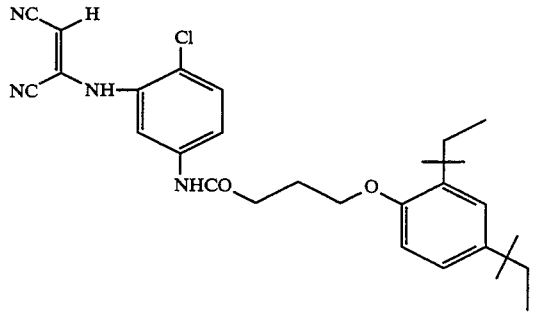
(C-1)
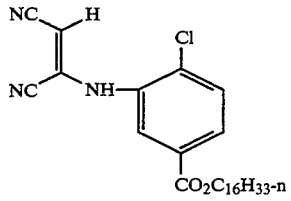
(C-2)
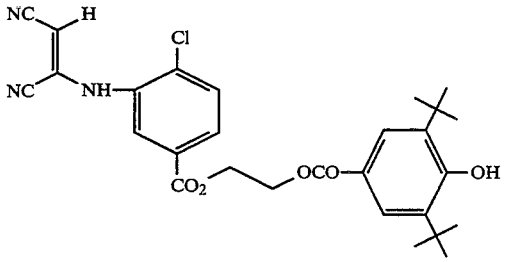
(C-3)
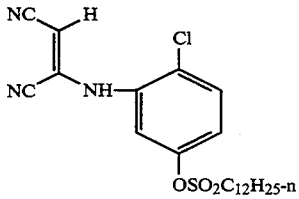
(C-4)
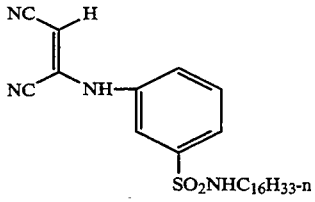
(C-5)
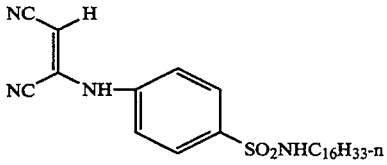
(C-6)

TABLE 3-continued
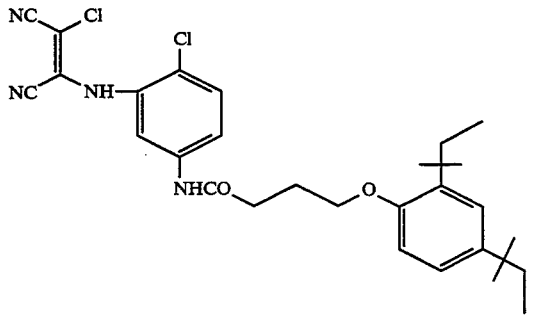
(C-7)
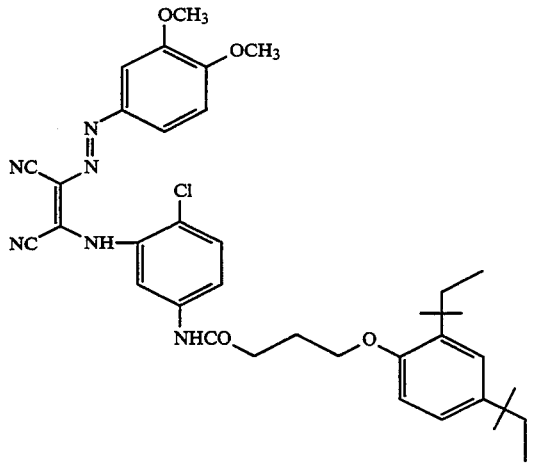
(C-8)
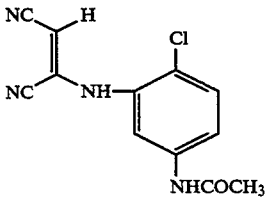
(C-9)
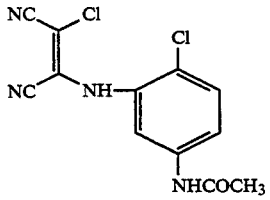
(C-10)
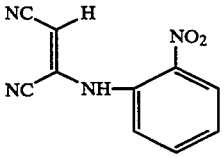
(C-11)
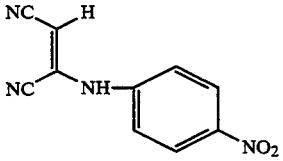
(C-12)
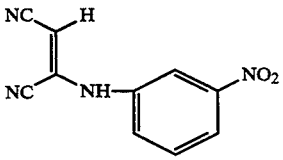
(C-13)
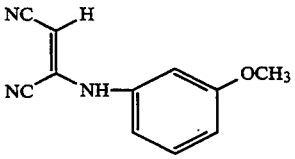
(C-14)
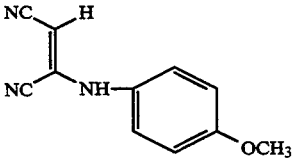
(C-15)
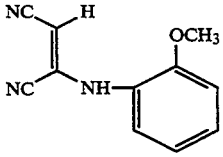
(C-16)

TABLE 3-continued
(C-17)
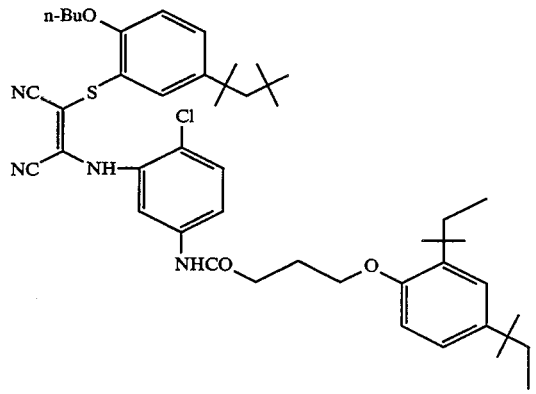
(C-18)
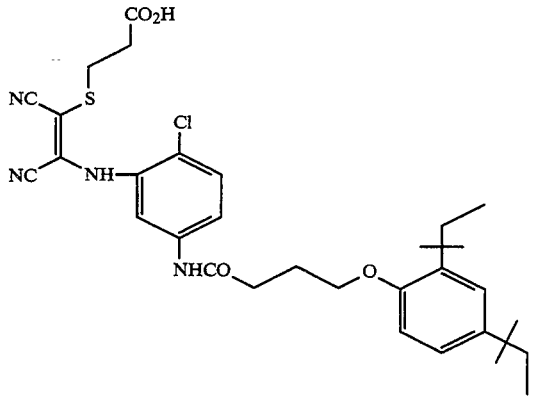
(C-19)
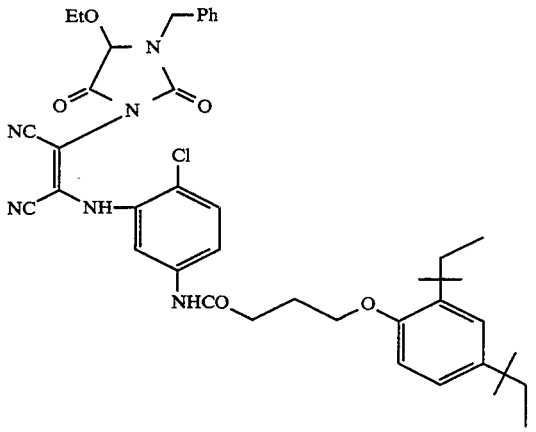
(C-20)
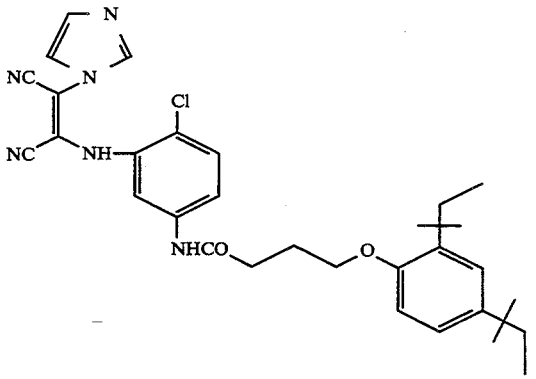

TABLE 3-continued
(C-21)
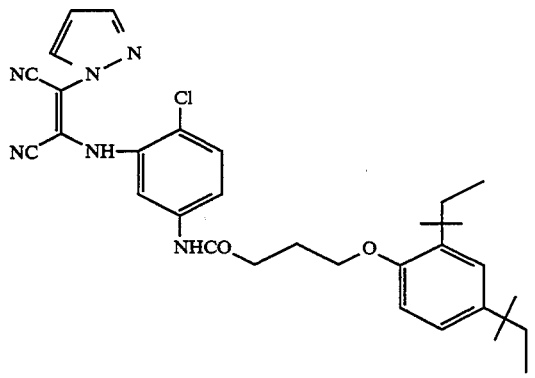
(C-22)
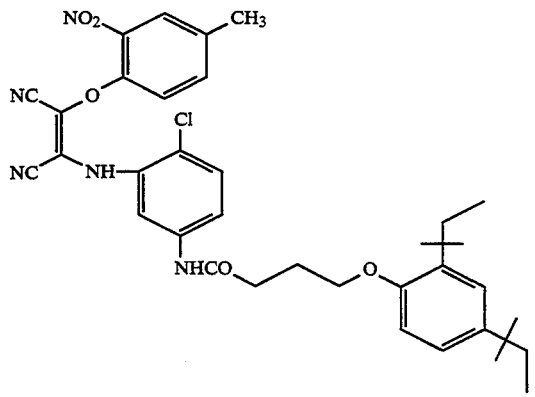
(C-23)
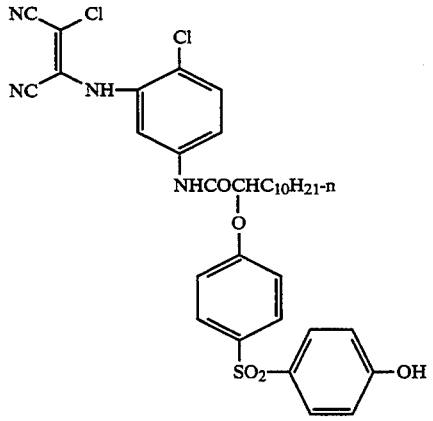

TABLE 3-continued
(C-24)
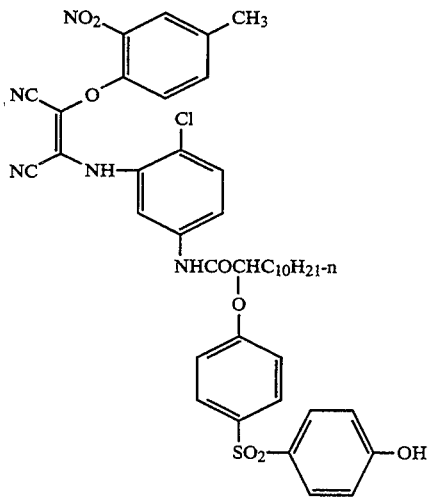
(C-25)
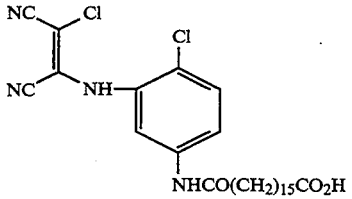
(C-26)
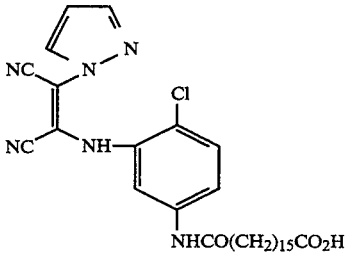
(C-27)
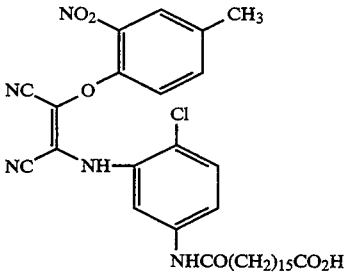
(C-28)
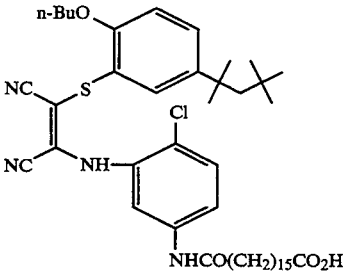

TABLE 3-continued
(C-29)
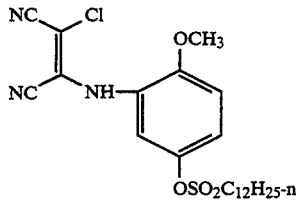
(C-30)
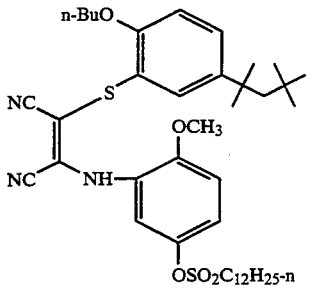
(C-31)
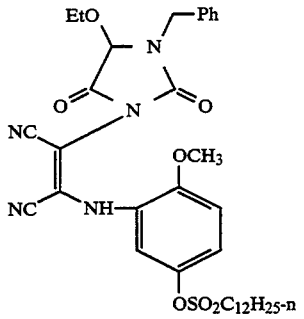
(C-32)
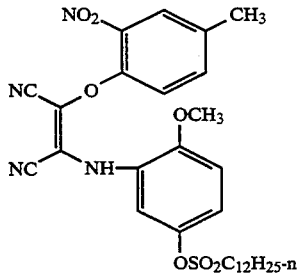
(C-33)
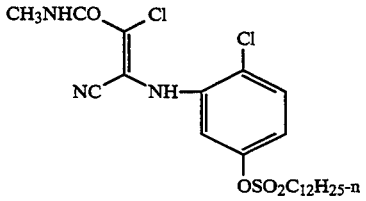
(C-34)
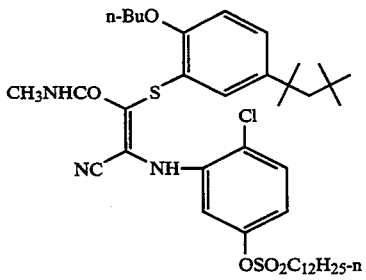

TABLE 3-continued
(C-35)
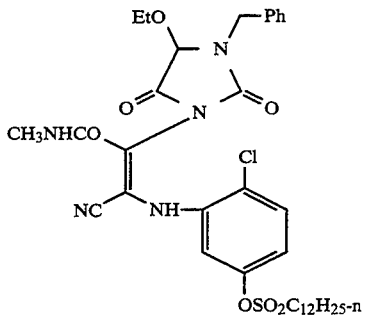
(C-36)
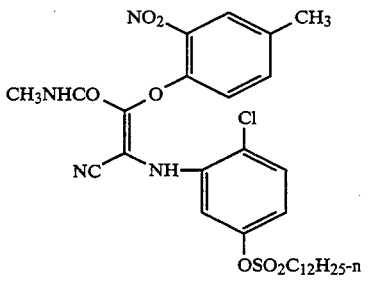
(C-37)
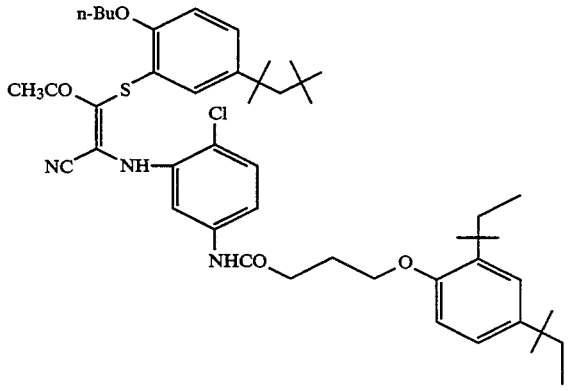
(C-38)
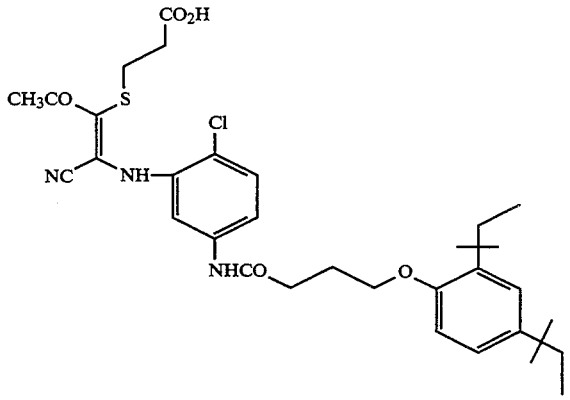

TABLE 3-continued
(C-39)
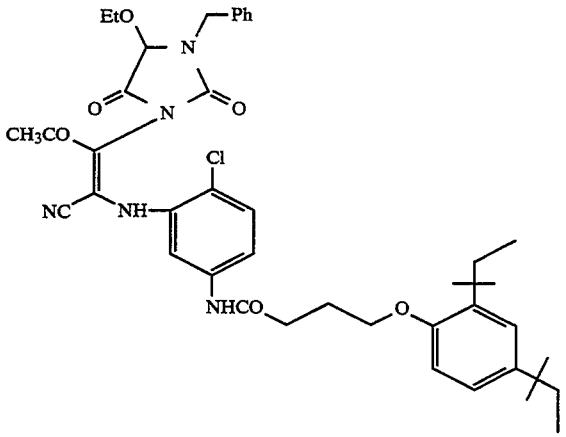
(C-40)
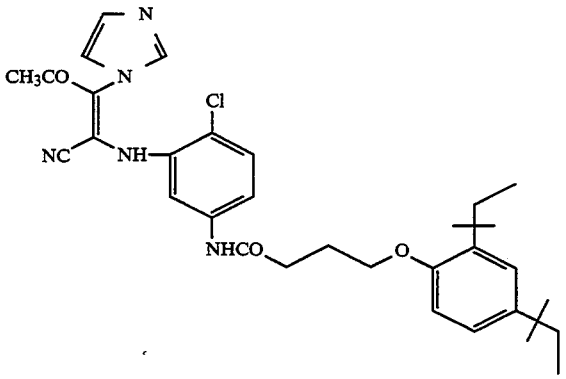
(C-41)
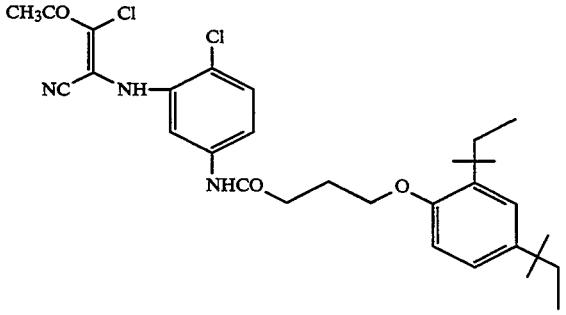
(C-42)
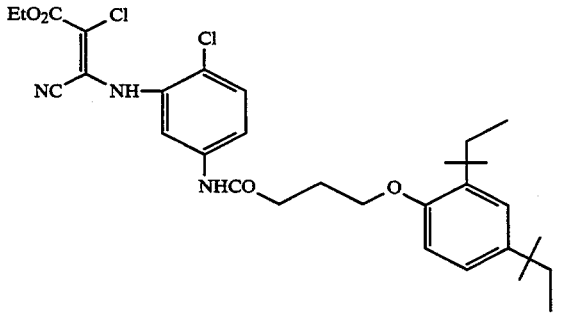

TABLE 3-continued
(C-43)
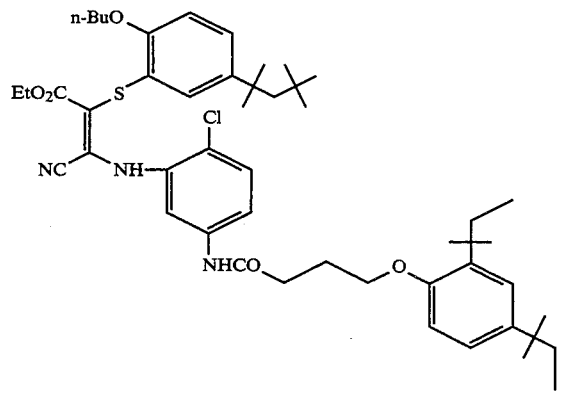
(C-44)
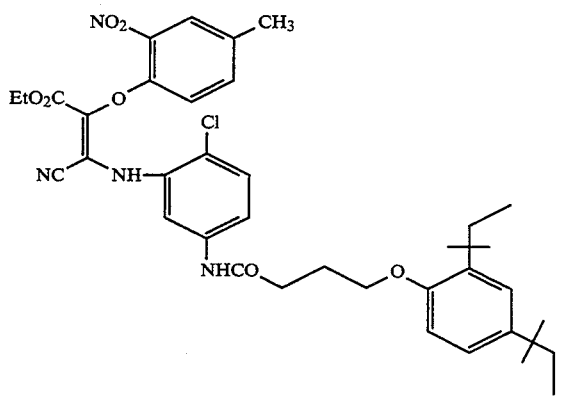
(C-45)
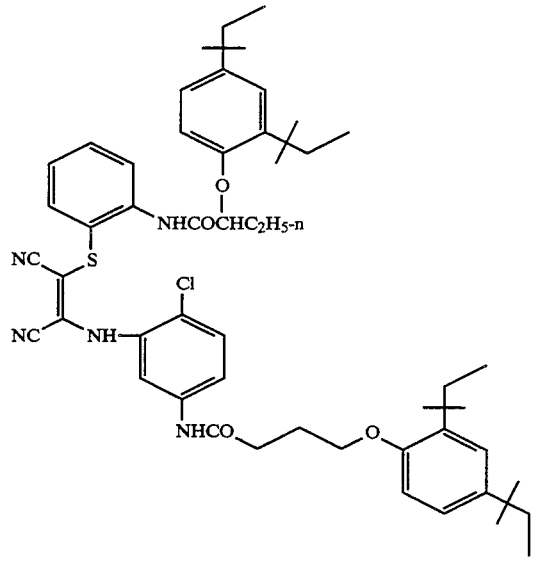

TABLE 3-continued
(C-46)
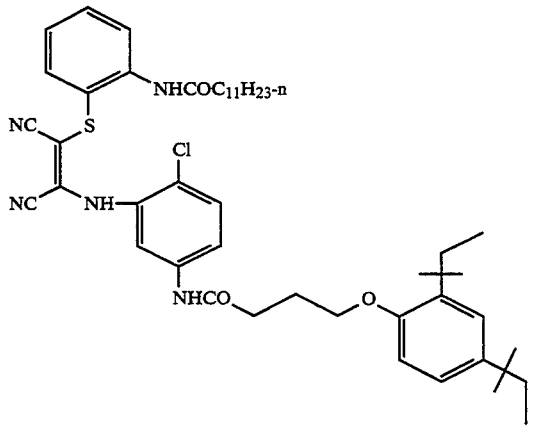
(C-47)
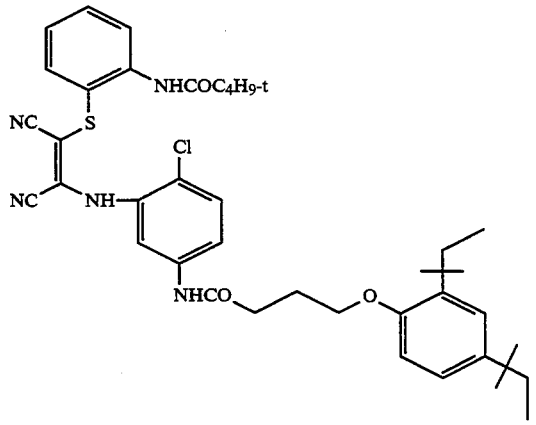
(C-48)
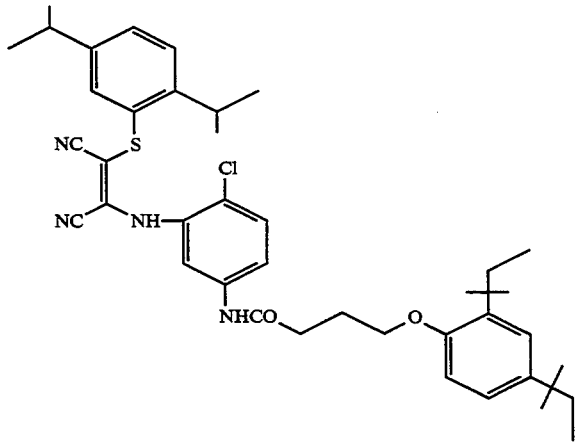

TABLE 3-continued
(C-49)
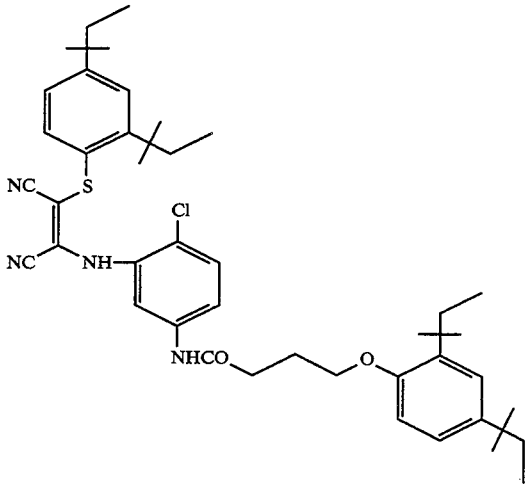
(C-50)
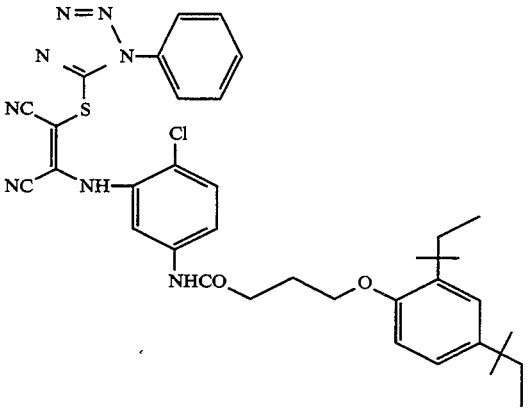
(C-51)
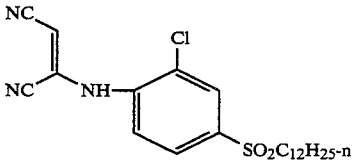
(C-52)
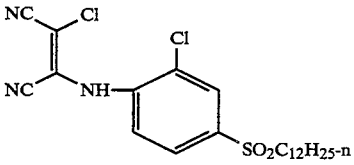
(C-53)
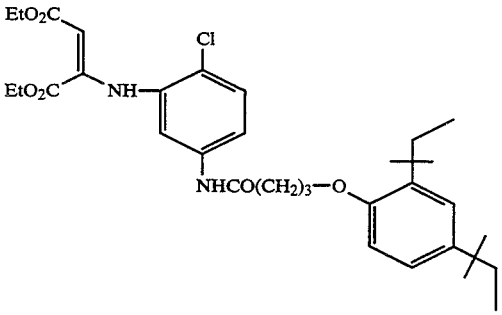

TABLE 3-continued
(C-54)
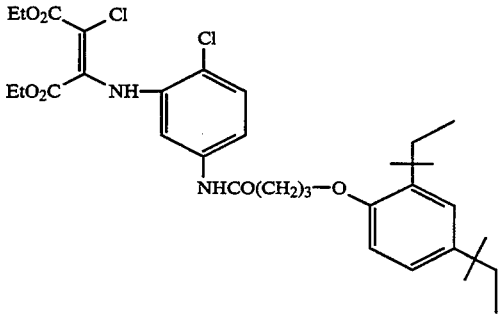
(C-55)
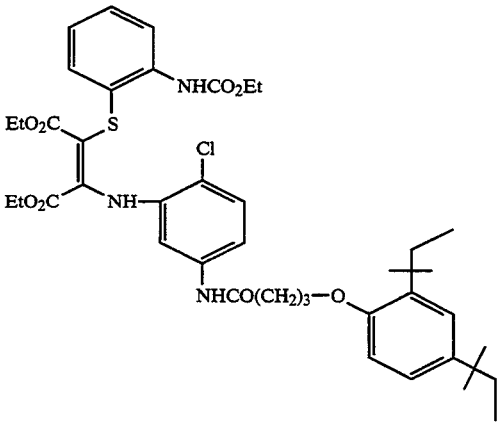
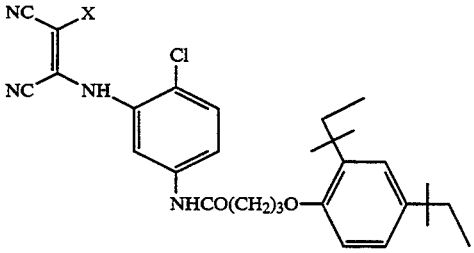
Where X is:-
C-56
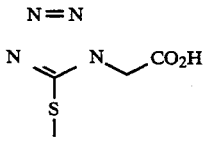
C-57
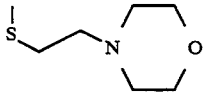
C-58
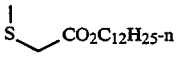
C-59
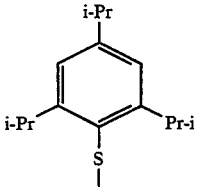
C-60
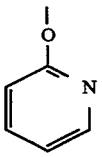
C-61
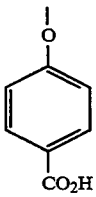
C-62
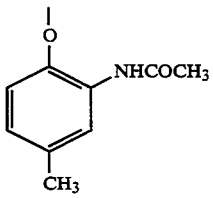
C-63
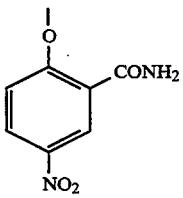
C-64
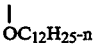
C-65
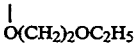
C-66
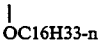
C-67
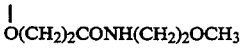
C-68 C-69 C-70 C-71

TABLE 3-continued
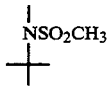
C-72
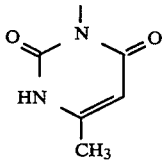
C-73
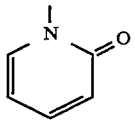
C-74
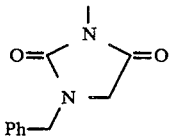
C-75
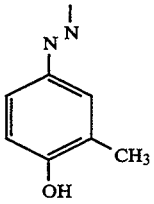
C-76
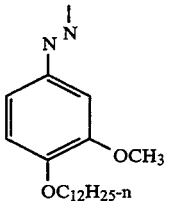
C-77
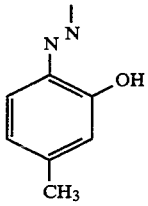
C-78
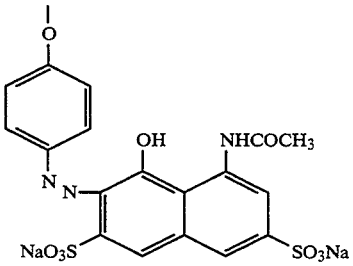
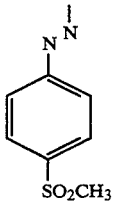
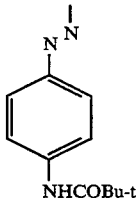
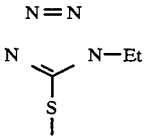
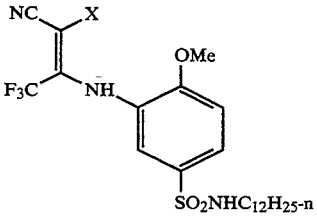
Where X is:-
C-79
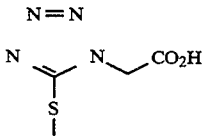
C-80
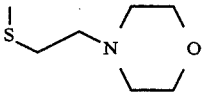
C-81
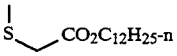
C-82
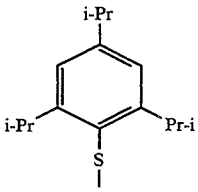
C-83
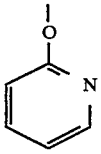
C-84
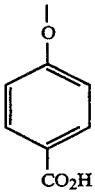
C-85
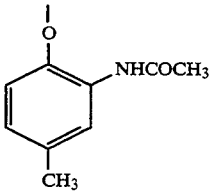
C-86
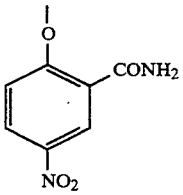
C-87
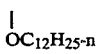
C-88
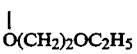
C-89
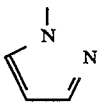
C-90
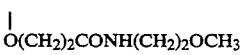
C-91 C-92 C-93 C-94

TABLE 3-continued
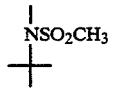
C-95
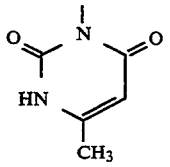
C-96
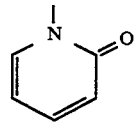
C-97
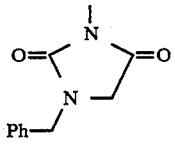
C-98
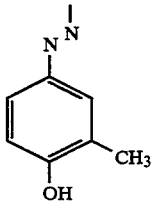
C-99
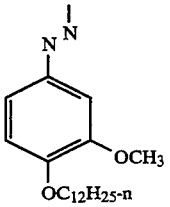
C-100
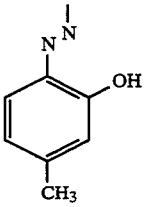
C-101
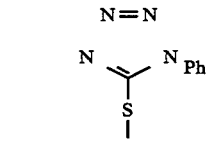
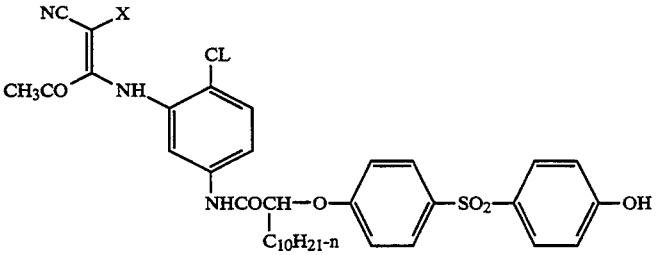
Where X is:-
C-102
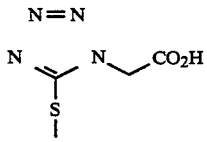
C-103
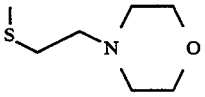
C-104
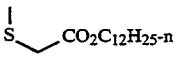
C-105
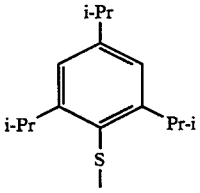
C-106
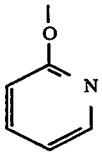
C-107
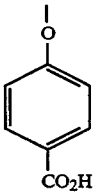
C-108
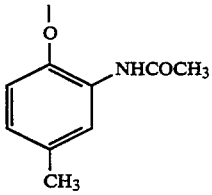
C-109
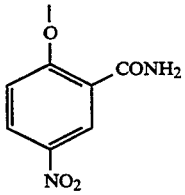
C-110
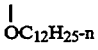
C-111
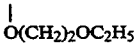
C-112
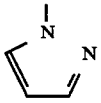
C-113
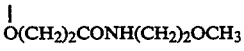

TABLE 3-continued
C-114
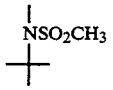
C-115
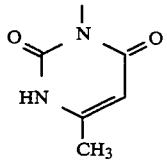
C-116
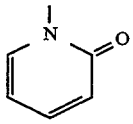
C-117
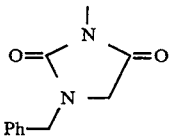
C-118
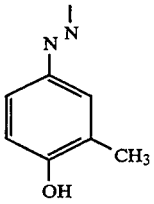
C-119
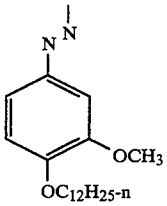
C-120
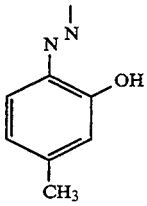
C-121
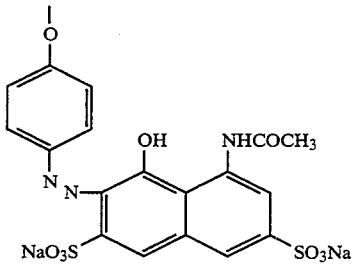
C-122
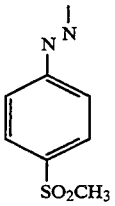
C-123
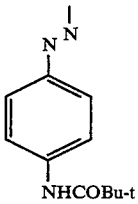
C-124
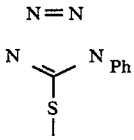
C-125
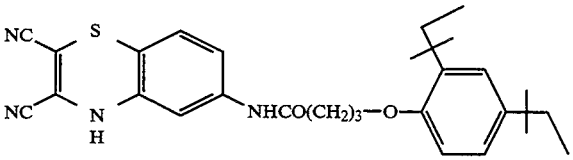
C-126
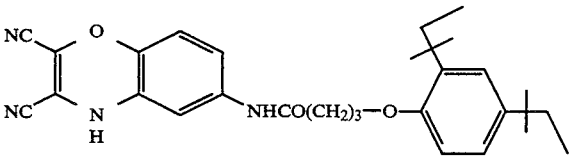
C-127
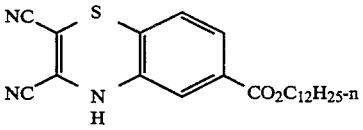
C-128
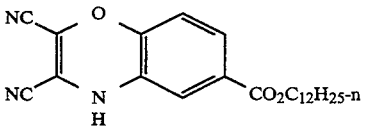
C-129
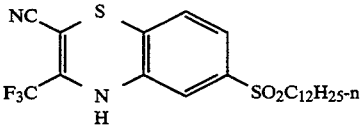
C-130
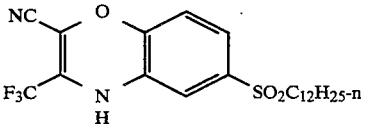
C-131
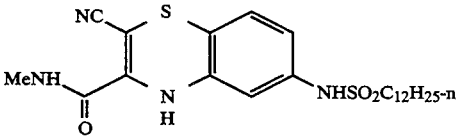
C-132
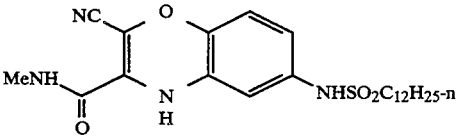

TABLE 3-continued
C-133
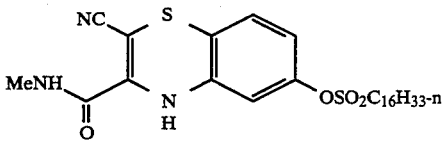
C-134
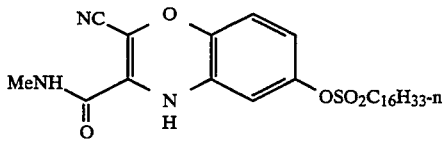
C-135
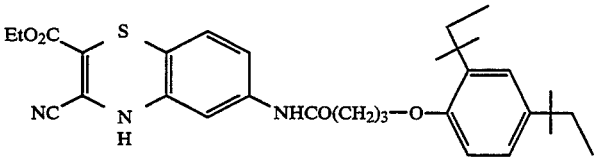
C-136
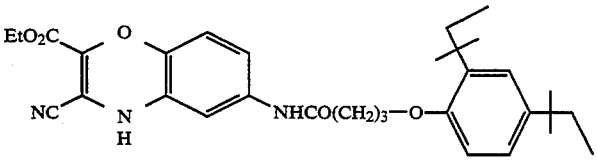
C-137
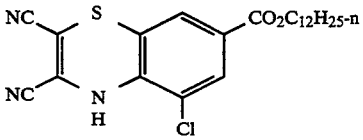
C-138
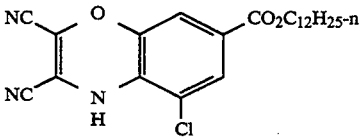
C-139
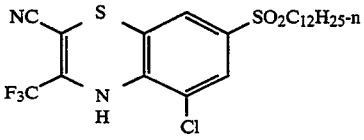
C-140
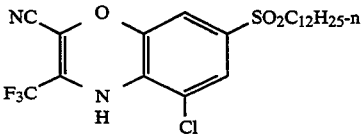
C-141
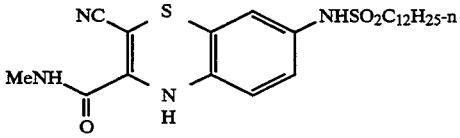
C-142
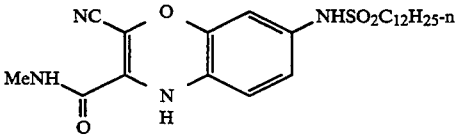
C-143
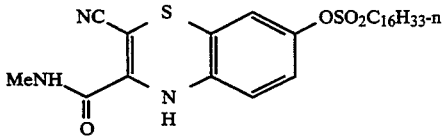
C-144
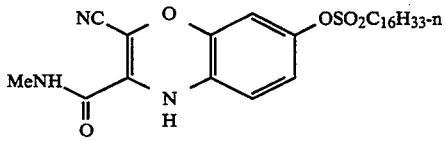
C-145
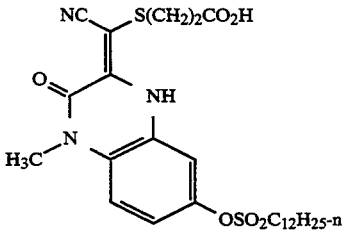
C-146
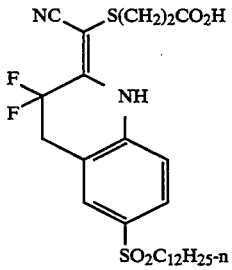
C-147
C-148

TABLE 3-continued
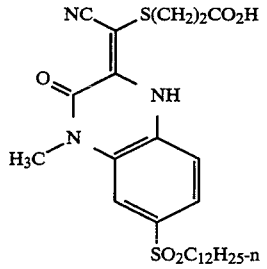
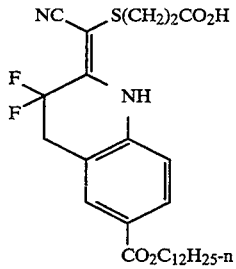
C-149
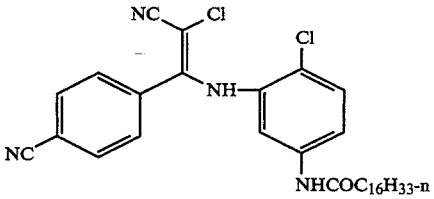
C-150
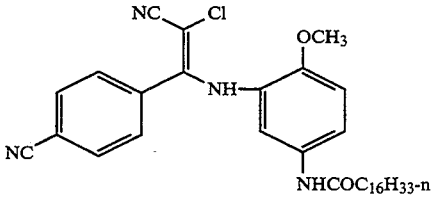
C-151
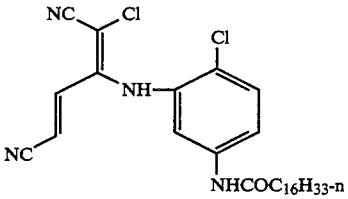
C-152
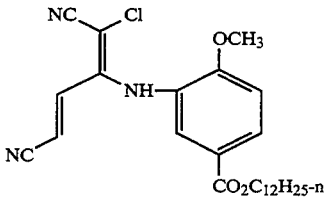
C-153
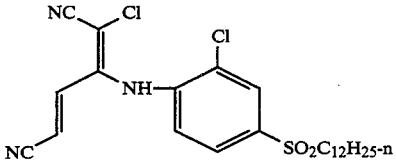
C-154
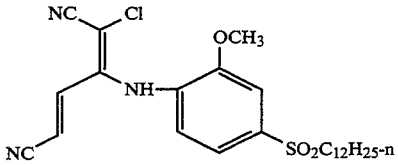
C-155
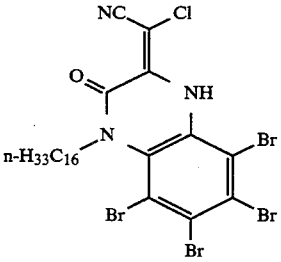
C-156
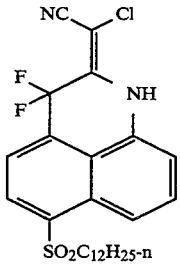
C-157
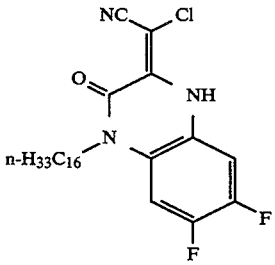
C-158
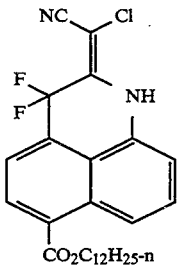
C-159
C-160

TABLE 3-continued
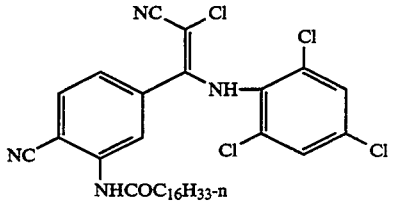
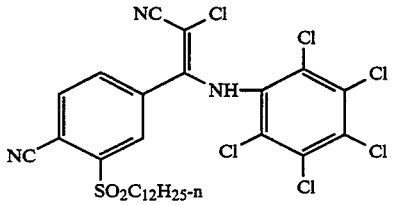
C-161
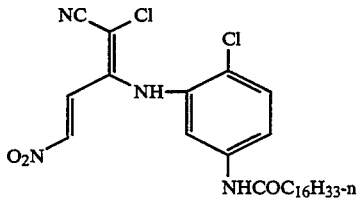
C-162
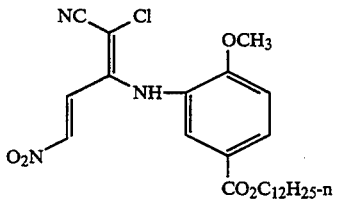
C-163
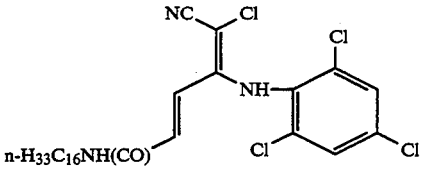
C-164
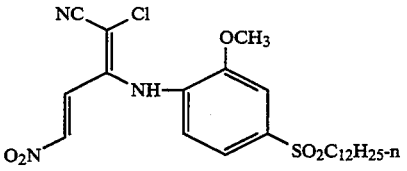
(C-165)
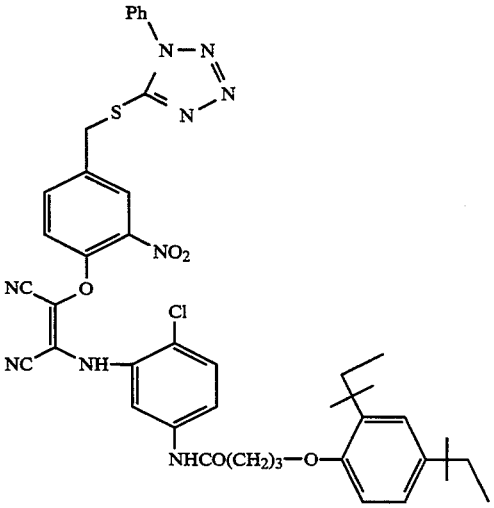
(C-166)
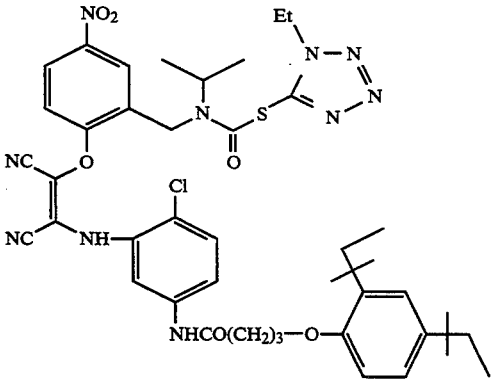

TABLE 3-continued
(C-167)
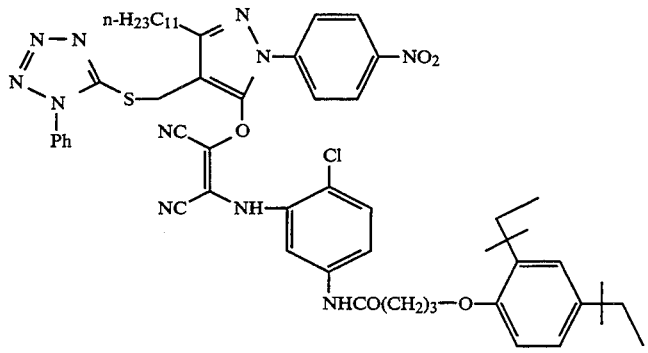
(C-168)
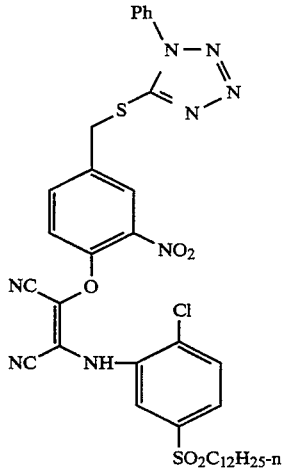
(C-169)
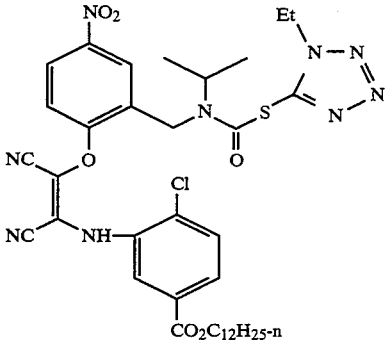
(C-170)
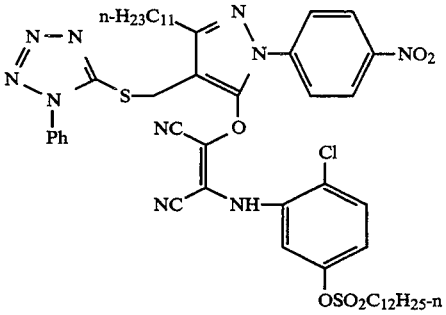

TABLE 3-continued
(C-171)
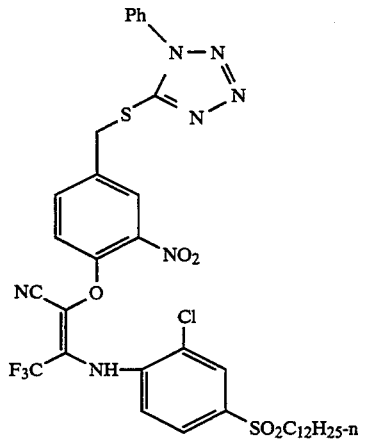
(C-172)
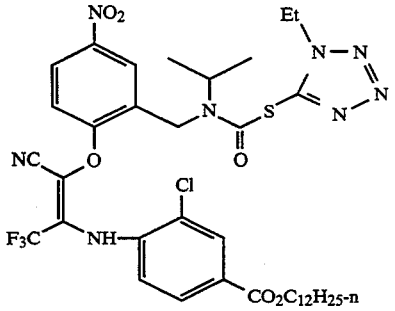
(C-173)
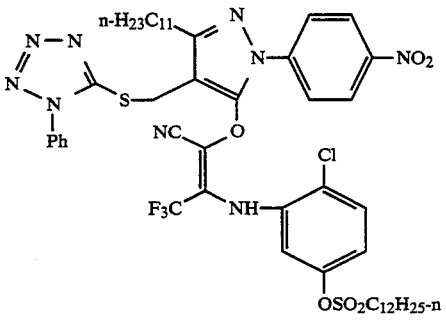
(C-174)
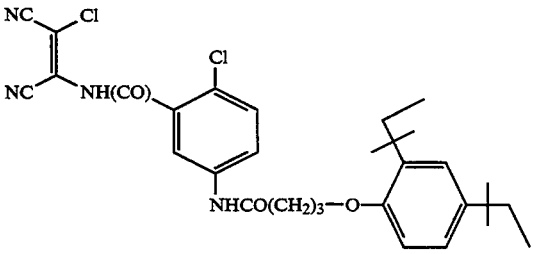
(C-175)
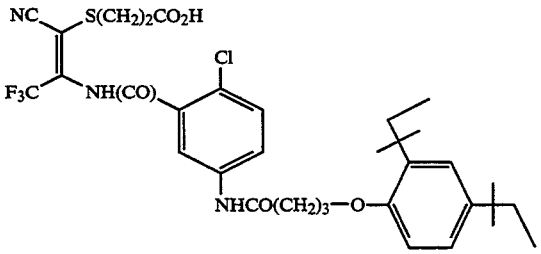

TABLE 3-continued
(C-176)
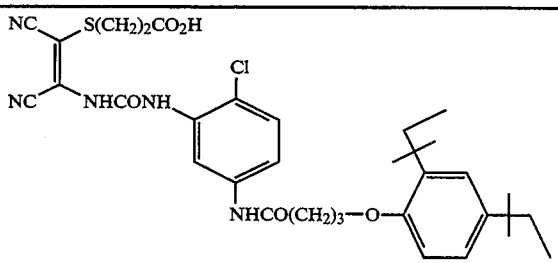
(C-177)
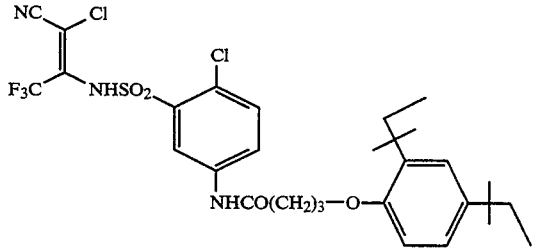
(C-178)
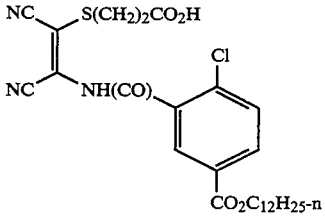
(C-179)
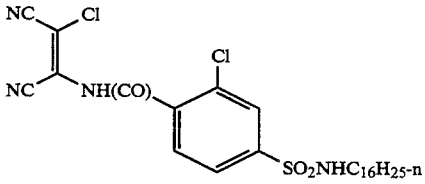
C-180
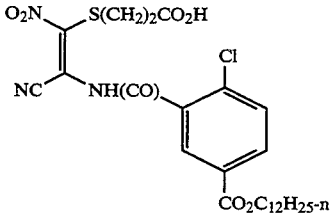
C-181
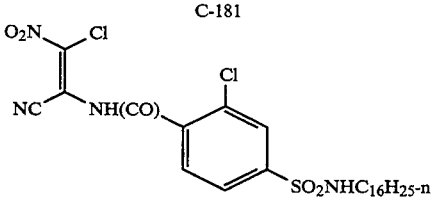
C-182
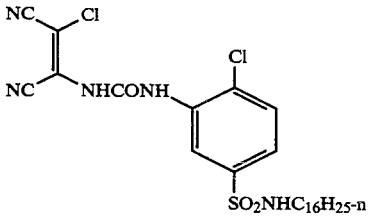
C-183
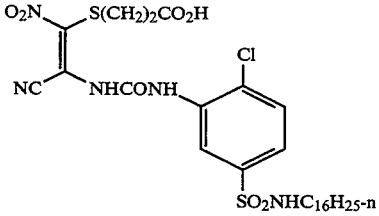
C-184
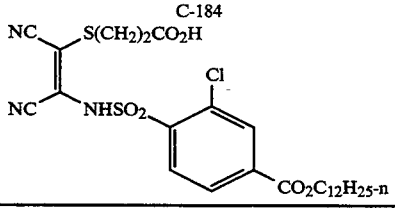
C-185
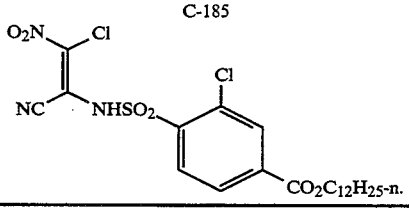

8. A photographic element as claimed in claim 1 in which R may be a group of the general formula:

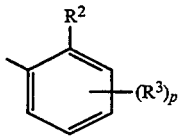

wherein p is 0 to 4 and each $R^3$ is the same or different substituent, and $R^2$ is a hydrogen or halogen atom or an alkyl, alkoxy, aryloxy, alkylthio, arylthio, carbonamido, carboamoyl, sulphonamido, sulphamoyl, alkylsulphonyl, arylsulphonyl, alkoxycarbonyl, acyloxy, acyl, cyano, nitro, or trifluoromethyl group.

9. A photographic element as claimed in claim 8 in which p is 0 to 3 and each $R^3$ is in a meta or para position with respect to $R^2$ and is individually a halogen atom or an alkyl, alkoxy, aryloxy, carbonamido, carbamoyl, sulphonamido, sulfamoyl, alkylsulphoxyl, arylsulphoxyl, alkylsulphonyl, arylsulphonyl, alkoxycarbonyl, aryloxycarbonyl, acyloxy, ureido, imido, carbamate, cyano, nitro, acyl, trifluoromethyl, alkylthio, carboxyl or heterocylic group.

10. A photographic element as claimed in claim 1 wherein the stabilizer is of formula (I) or (II):

(I)

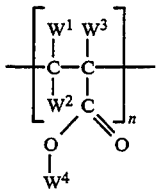

(II)

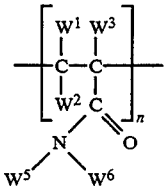

wherein:

$W^1$, $W^2$, $W^3$, $W^4$, $W^5$ and $W^6$ are, independently, an aliphatic, aromatic or heterocyclic group, any of which may be substituted or unsubstituted, or hydrogen or halogen.

11. A photographic element as claimed in claim 10 wherein $W^1$, $W^2$, $W^3$, $W^4$, $W^5$ and $W^6$ have no more than 10 carbon atoms.

12. A photographic element as claimed in claim 11 wherein $W^1$, $W^2$, $W^3$, $W^4$, $W^5$ and $W^6$ are, independently, alkyl, aryl or heterocyclic, any of which may be substituted or unsubstituted, or hydrogen or halogen.

13. A photographic element as claimed in claim 11 wherein $W^1$ and $W^2$ are hydrogen.

14. A photographic element as claimed in claim 11 wherein the stabilizer has a molecular weight of between 1,000 and 150,000.

* * * * *

UNITED STATES PATENT AND TRADEMARK OFFICE

CERTIFICATE OF CORRECTION

PATENT NO. : 5,436,124

DATED : July 25, 1995

INVENTOR(S) : Rakesh Jain et al

It is certified that error appears in the above-indentified patent and that said Letters Patent is hereby corrected as shown below:

Column 78, claim 1, lines 5 and 6: Delete the language "which may be substituted, $-COR^1$, $-CSR^1$, $SOR^1$, $SO_2R^1$," and insert the deleted language following the word "heterocyclic" in line 7.

Column 78, claim 6, line 56: Insert a comma after the words "siloxy" and "aryl".

Signed and Sealed this

Thirteenth Day of February, 1996

Bruce Lehman

*Attest:*

BRUCE LEHMAN

*Attesting Officer*

*Commissioner of Patents and Trademarks*